US009476239B2

(12) United States Patent
Honeycutt et al.

(10) Patent No.: US 9,476,239 B2
(45) Date of Patent: Oct. 25, 2016

(54) GATE

(71) Applicant: Safe Rack LLC, Andrews, SC (US)

(72) Inventors: Robert W. Honeycutt, Pawleys Island, SC (US); Carson Allan Jones, Charleston, SC (US)

(73) Assignee: Safe Rack LLC, Andrews, SC (US)

( * ) Notice: Subject to any disclaimer, the term of this patent is extended or adjusted under 35 U.S.C. 154(b) by 0 days.

(21) Appl. No.: 14/714,977

(22) Filed: May 18, 2015

(65) Prior Publication Data

US 2015/0252605 A1 Sep. 10, 2015

Related U.S. Application Data

(63) Continuation of application No. 13/768,179, filed on Feb. 15, 2013, now Pat. No. 9,032,666.

(60) Provisional application No. 61/599,276, filed on Feb. 15, 2012.

(51) Int. Cl.

| | |
|---|---|
| ***E06B 11/04*** | (2006.01) |
| ***E05F 1/12*** | (2006.01) |
| ***E06B 11/00*** | (2006.01) |
| ***E05D 7/00*** | (2006.01) |
| ***E05D 7/04*** | (2006.01) |
| ***E06B 11/02*** | (2006.01) |
| ***E06B 11/08*** | (2006.01) |

(52) U.S. Cl.

CPC ..... *E05F 1/1207* (2013.01); *E05D 7/0009* (2013.01); *E05D 7/0415* (2013.01); *E06B 11/00* (2013.01); *E06B 11/022* (2013.01); *E06B 11/04* (2013.01); *E06B 11/045* (2013.01); *E06B 11/085* (2013.01)

(58) Field of Classification Search

CPC .. E05F 1/1207; E06B 11/022; E06B 11/085; E06B 11/04; E06B 11/00; E05D 7/0009; E05D 7/0415

USPC ..... 49/55, 57, 463, 384

See application file for complete search history.

(56) References Cited

U.S. PATENT DOCUMENTS

| | | | | |
|---|---|---|---|---|
| 244,539 A * | 7/1881 | Boyden | ..... | E05F 1/1215 16/235 |
| 922,544 A | 5/1909 | Turner | | |
| 962,330 A * | 6/1910 | Fischer | ..... | E05F 1/1215 16/279 |

(Continued)

OTHER PUBLICATIONS

Extended European Search Report issued on Sep. 17, 2015 in corresponding European patent application No. 13749657.6.

(Continued)

*Primary Examiner* — Justin Rephann

(74) *Attorney, Agent, or Firm* — Nelson Mullins Riley & Scarborough, LLP

(57) ABSTRACT

A gate comprises a spring-loaded hinge arrangement defining a rotational axis. A gate structure having a first support arm connected to a first end of the hinge arrangement is also provided. The gate structure is rotatable about the rotational axis. A spring-loaded hinge arrangement includes an outer hinge tube fixedly connectable to an adjacent structure and an inner hinge tube received in the outer hinge tube. The inner hinge tube has a first portion and a second portion movable with respect to each other, the second portion of the inner hinge tube being fixed with respect to the outer hinge tube and the first portion of the inner hinge tube being fixed with respect to the support arm.

10 Claims, 25 Drawing Sheets

(56) References Cited

U.S. PATENT DOCUMENTS 1,236,536 A * 8/1917 Boyd ..... E05F 1/1215 16/285
1,540,490 A * 6/1925 Mertel ..... E06B 11/04 49/381
1,611,238 A * 12/1926 Sanborn ..... E05F 1/123 16/75
2,503,997 A 4/1950 Hopkins
2,574,807 A 11/1951 Woodruff
2,923,323 A 2/1960 Franck
3,222,805 A 12/1965 Hansen
3,510,986 A * 5/1970 Berkowitz ..... E05F 1/1215 16/256
3,674,294 A 7/1972 Kirkham
3,866,356 A * 2/1975 La Cook ..... E05F 1/1215 16/245
3,993,103 A 11/1976 Hammer
4,122,630 A 10/1978 Parisien
4,134,703 A 1/1979 Hinners
4,294,560 A 10/1981 Larkin
4,465,262 A 8/1984 Itri et al.
4,472,908 A * 9/1984 Wanzl ..... E05F 15/614 49/141
4,531,550 A 7/1985 Gartner
4,611,431 A 9/1986 Lauro
5,022,185 A 6/1991 Oatman
5,117,585 A 6/1992 Andrisin, III
5,119,861 A 6/1992 Pino
5,224,516 A 7/1993 McGovern et al.
5,272,840 A 12/1993 Knoedler et al.
5,575,113 A 11/1996 Huang
5,606,773 A * 3/1997 Shappell ..... E05F 1/123 16/298
5,692,856 A 12/1997 Newman et al.
5,704,164 A 1/1998 Huang
5,921,027 A 7/1999 Siebenahler
6,056,038 A 5/2000 Foster et al.
6,073,396 A 6/2000 Kietzmann
6,094,863 A * 8/2000 LaCook, Jr. ..... E06B 11/02 49/49
6,112,460 A 9/2000 Wagnitz
6,233,874 B1 5/2001 Johnson, Jr.
6,378,560 B1 4/2002 Ferrer
6,474,021 B2 11/2002 Homeyer
6,477,736 B1 * 11/2002 Abernathy ..... E05F 1/1016 16/72
D485,911 S * 1/2004 Learning ..... D25/48.5
6,684,566 B2 * 2/2004 LaCook ..... E06B 11/02 16/250
7,334,624 B2 2/2008 Waldman et al.
7,422,048 B2 9/2008 Andersen
7,658,220 B2 2/2010 Yates
7,950,095 B2 5/2011 Honeycutt et al.
8,046,858 B2 11/2011 Honeycutt
8,261,393 B2 9/2012 Honeycutt et al.
8,297,336 B2 10/2012 Yates
8,341,821 B2 1/2013 Honeycutt
8,418,407 B2 4/2013 Wang
8,561,349 B2 10/2013 Flannery et al.
8,578,656 B2 11/2013 Yates et al.
9,032,666 B2 5/2015 Honeycutt et al.
2003/0230328 A1 12/2003 Chen
2005/0028947 A1 2/2005 Waldman et al.
2005/0207829 A1 9/2005 Lenhart
2005/0220917 A1 10/2005 Pierik et al.
2007/0051934 A1 * 3/2007 LaCook ..... E06B 11/085 256/73
2007/0089273 A1 * 4/2007 Kang ..... E05D 11/1078 16/330
2007/0113378 A1 * 5/2007 Talpe ..... E05F 1/1215 16/298
2007/0144691 A1 6/2007 Yates
2008/0244983 A1 10/2008 Peterson
2008/0256865 A1 10/2008 Trujillo et al.
2009/0071074 A1 3/2009 Yates
2009/0158665 A1 6/2009 Wu
2009/0217591 A1 9/2009 LaCook
2009/0241610 A1 10/2009 Watts et al.
2010/0031455 A1 2/2010 Honeycutt et al.
2010/0083577 A1 4/2010 Flannery et al.
2010/0316438 A1 12/2010 Sohn
2010/0319260 A1 * 12/2010 Sawa ..... E05F 1/1223 49/326
2011/0072618 A1 * 3/2011 Chen ..... E05F 1/1215 16/303
2011/0258834 A1 10/2011 Allen et al.
2011/0302743 A1 * 12/2011 Kim ..... E05F 1/1215 16/248
2012/0017393 A1 * 1/2012 Pate, Jr. ..... E05F 1/1215 16/273
2012/0056144 A1 3/2012 Woods
2013/0045041 A1 2/2013 Sohn
2013/0086842 A1 4/2013 Morrone, III

OTHER PUBLICATIONS

Owner's Manual, "Yellow Gate," www.yelloegate.com, Doc. No. YG-2011.

International Search Report (Form PCT/ISA/210) and Written Opinion (Form PCT/ISA/237) dated May 6, 2013 for corresponding PCT application serial No. PCT/US2013/026306.

* cited by examiner

GATE

CROSS REFERENCE TO RELATED APPLICATIONS

This application is a continuation of copending application Ser. No. 13/768,179, filed Feb. 15, 2013, which claims the benefit of priority to U.S. Provisional Patent Application No. 61/599,276 filed on Feb. 15, 2012. Both of the foregoing applications are incorporated herein in their entirety for all purposes.

FIELD

Embodiments of the present invention relates to fall restraint equipment, and, more particularly, to a swing gate for fall restraint equipment.

BACKGROUND OF THE INVENTION

Fall restraint equipment may include platforms, ramps, bridges, steps, guardrails, gangways, cages, gates, and other support structures. Gangways, for instance, may be used to provide access to an area, such as the top of a storage container. For example, a semi-trailer truck or a railroad carriage transporting dry goods may need to be unloaded from the container's top. A gangway is used to provide workers a path to unload the material. Additionally, an articulating cage may be lowered from the gangway or, alternatively, from a support structure in order to encase the area from which the material is to be unloaded. Platform systems typically provide access from one location of an area to another. The access points along the platform system or along other portions of fall restraint equipment may provide access to desired locations, such as the top of a railroad carriage, but typically leave a gap in the system or equipment when not in use. Gates may be used to cover the gaps but generally are manufactured to fit the specific dimensions of the gap. Once manufactured, the gate typically cannot be used to cover a gap exhibiting different dimensions.

SUMMARY OF THE INVENTION

Embodiments of the present invention address the foregoing deficiencies. In some embodiments, aspects of the present invention relate to an adjustable gate which has a pair of supporting arms with interior cavities. An adjustable arm has ends which may be inserted into the pair of supporting arms. At least one of the adjustable arm ends has a system to adjust the length of the gate. For example, the adjustable system may be a rubber compression member that, when adjusted, locks the adjustable arm into place relative to the pair of supporting arms. This allows the gate to be infinitely adjustable.

In another example, apertures may be disposed in the pair of supporting arms and an aperture in the adjustable arm ends align with a desired aperture in the supporting arms so that a pin may be inserted therein to lock the adjustable arm into place relative to the supporting arm.

According to one embodiment, a gate may include a first supporting arm and an adjustable arm. The first supporting arm may include an interior surface and an interior cavity. The adjustable arm may include an insertable end, an adjustable compression member and a compression fitting. The insertable end may be configured to be inserted into the interior cavity of the first supporting arm. The adjustable compression member may be disposed at the insertable end. The compressing fitting may be configured to adjust the adjustable compression member. When the insertable end is inserted into the interior cavity of the first supporting arm, the adjustable compression member is adjusted to compress against the interior surface so that the adjustable arm is fixed relative to the first supporting arm.

According to another embodiment, a method of operating an adjustable gate may include providing a gate that includes a hinge; a first supporting arm comprising an interior surface and an interior cavity; and an adjustable arm. The adjustable arm may include an insertable end configured to be inserted into the interior cavity of the first supporting arm; an adjustable compression member disposed at the insertable end; and a compressing fitting configured to adjust the adjustable compression member. The method may further include adjusting the compression fitting so that the adjustable compression member expands or compresses within the interior cavity and so that the adjustable compression member compresses against the interior surface so that the adjustable arm is fixed relative to the first supporting arm.

BRIEF DESCRIPTION OF THE DRAWINGS

A full and enabling disclosure of the present invention, including the best mode thereof directed to one of ordinary skill in the art, is set forth in the specification, which makes reference to the appended drawings that illustrate various components of an adjustable, mountable gate in accordance with various embodiments of the present invention.

Figure 1A:
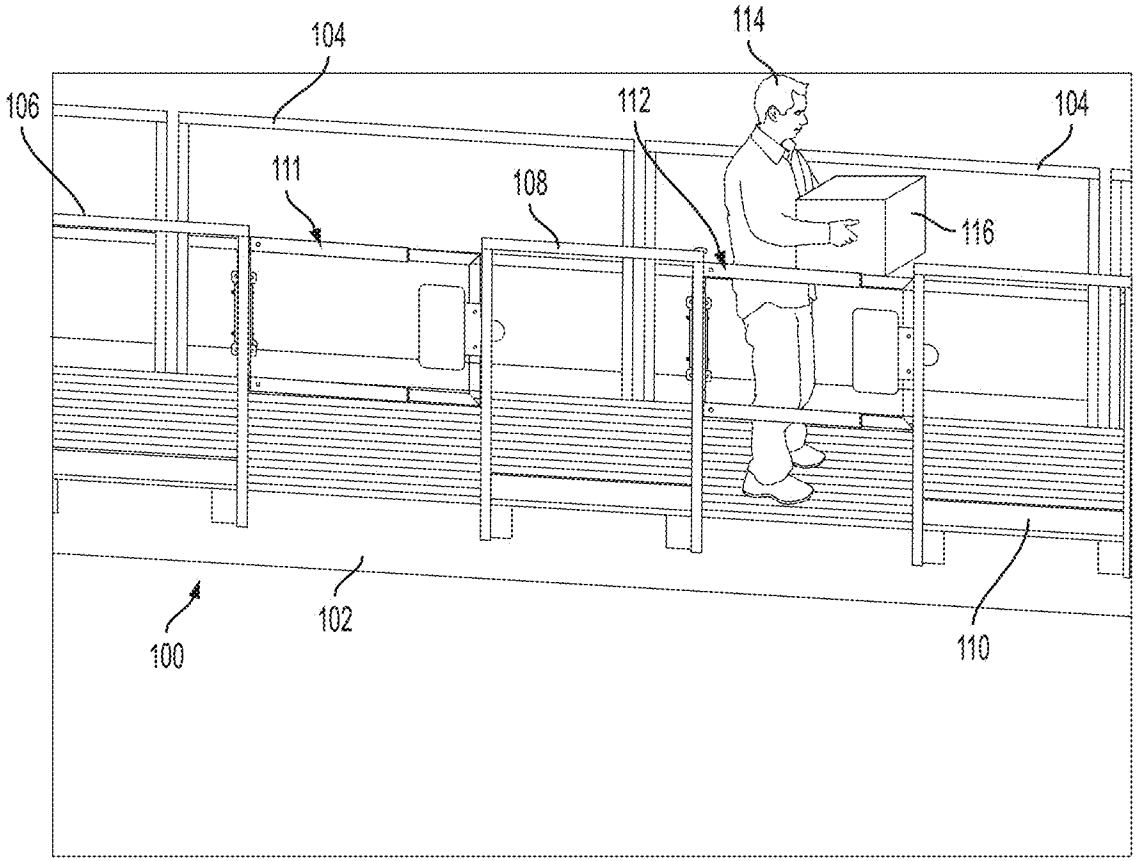
FIGS. 1A and 1B are perspective view showing a pair of gates on a gangway in accordance with an embodiment of the present invention.

Repeat use of reference characters in the present specification and drawings is intended to represent same or analogous features or elements of the invention.

DESCRIPTION OF EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Aspects of the present invention are related to fall restraint equipment. Examples of fall restraint equipment and the components thereof are set forth in copending U.S. patent application Ser. No. 12/329,883 (entitled "A Gangway and Method of Manufacturing Same" and filed on Dec. 8, 2008), Ser. No. 12/468,704 (entitled "Fall Restraint Equipment Component and Method for Manufacturing the Same" and filed on May 19, 2009), Ser. No. 12/487,408 (entitled "Fall Restraint Equipment Component and Method for Manufacturing the Same" and filed on Jun. 18, 2009), Ser. No. 12/537,842 (entitled "Fall Restraint Equipment Components and Method for Manufacturing the Same" and filed on Aug. 7, 2009), Ser. No. 12/552,811 (entitled "Gangway Handrail and Method for Manufacturing the Same" and filed on Sep. 2, 2009), Ser. No. 12/837,480 (entitled "Mobile Access Unit and Cage" and filed on Jul. 15, 2010), 61/366,612 (entitled "Gangway Bearing Retainer Plate" and filed on Jul. 22, 2010), and 61/374,541 (entitled "Articulating Cage" and filed on Aug. 17, 2010). The entire disclosure of each of the foregoing applications is hereby incorporated by reference as if set forth verbatim herein.

The present invention recognizes and addresses the foregoing considerations, and others, of prior art construction and methods.

In this regard, one aspect of the present invention provides a gate that may change sizes and be mounted in different configurations.

Figure 1B:
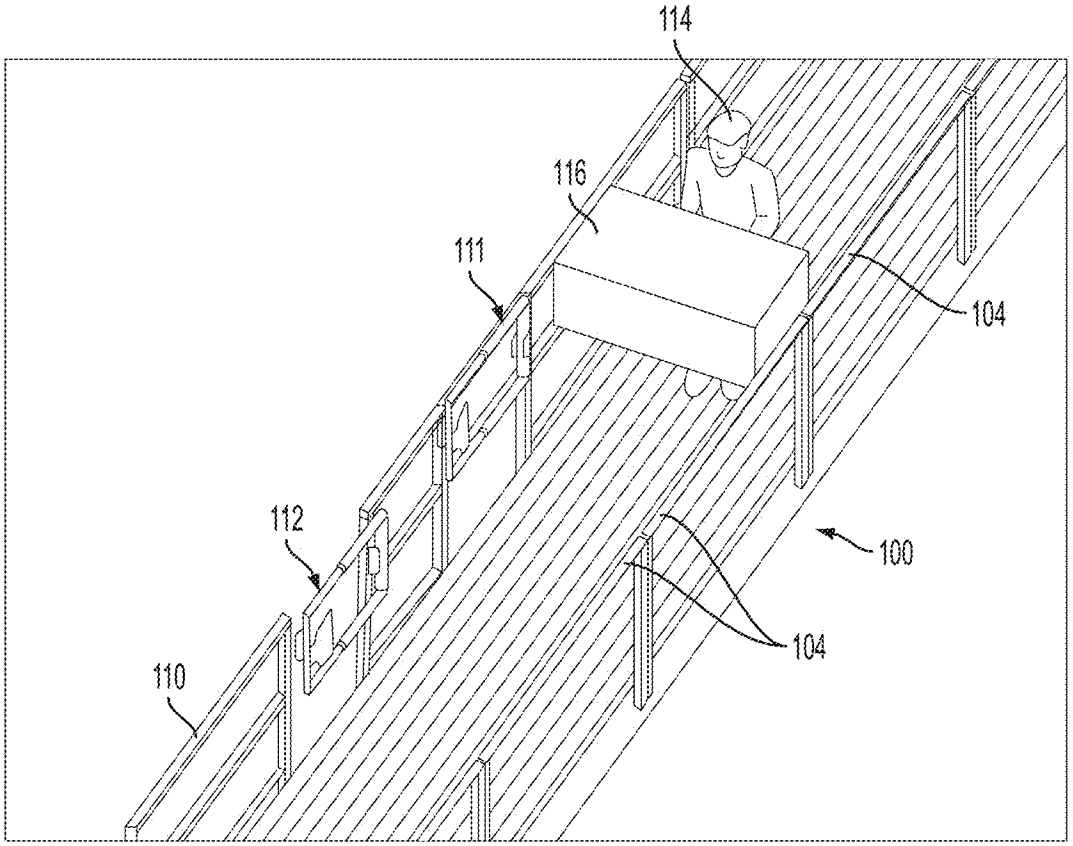

FIG. 1A and FIG. 1B (collectively FIG. 1) illustrate two gates 111, 112 on a gangway 100. Gangway 100 includes a series of handrails 104, 106, 108 and 110 (which may form a cage). Gate 111 is disposed between a first handrail 106 and a second handrail 108 so that gate 111 creates an accessway therebetween. In a similar manner, gate 112 is disposed between a third handrail 110 and second handrail 108 to create another accessway therebetween. Gates 111 and 112 are configured to cover the accessways in one position and when opened, open the accessways. The accessways are sized to allow a user 114 and/or an item 116 to pass therebetween.

Gangway 100 may be placed over a storage container from above according to one embodiment. Storage container (not shown) typically may contain material, such as particulate matter, to be unloaded from the container's top. A platform 102 of gangway 100 provides user 114 an area to walk on gangway 100.

Figure 2A:
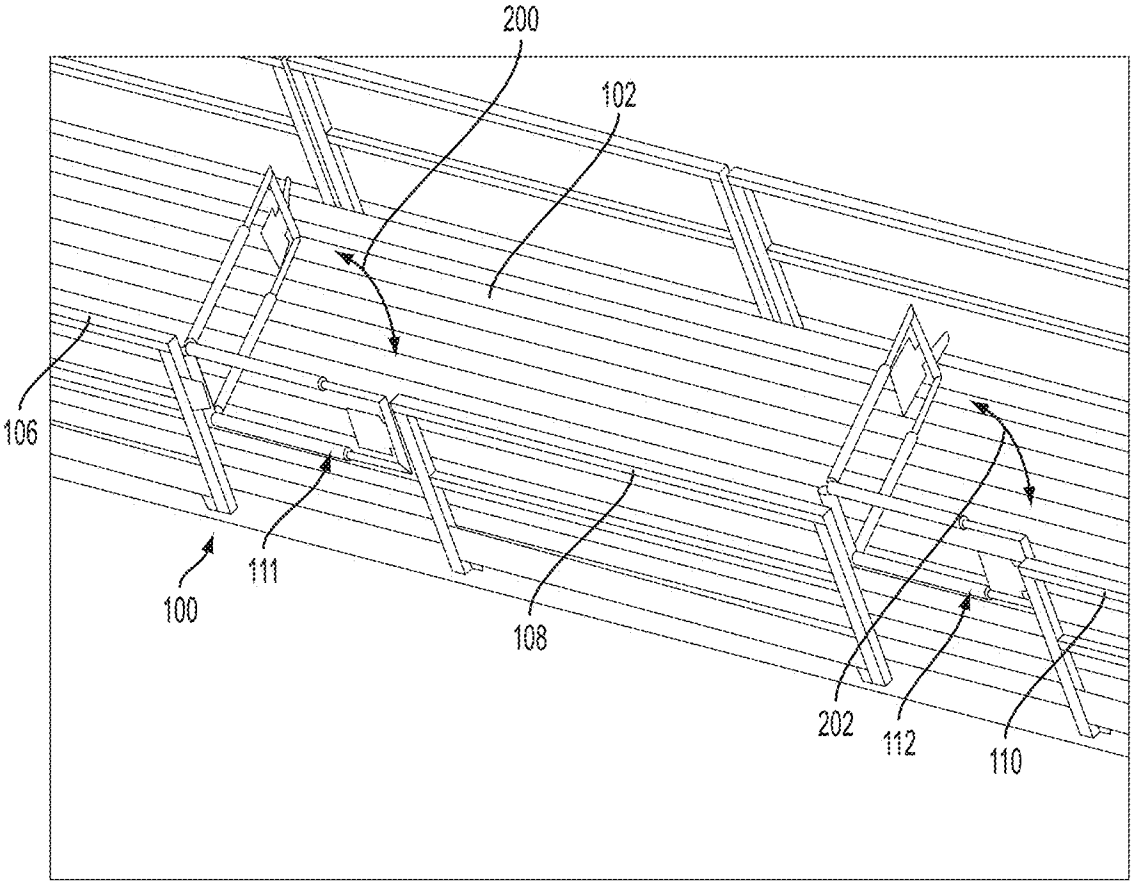
FIGS. 2A and 2B illustrate the gates of FIGS. 1A and 1B in both open and closed positions.
Figure 2B:
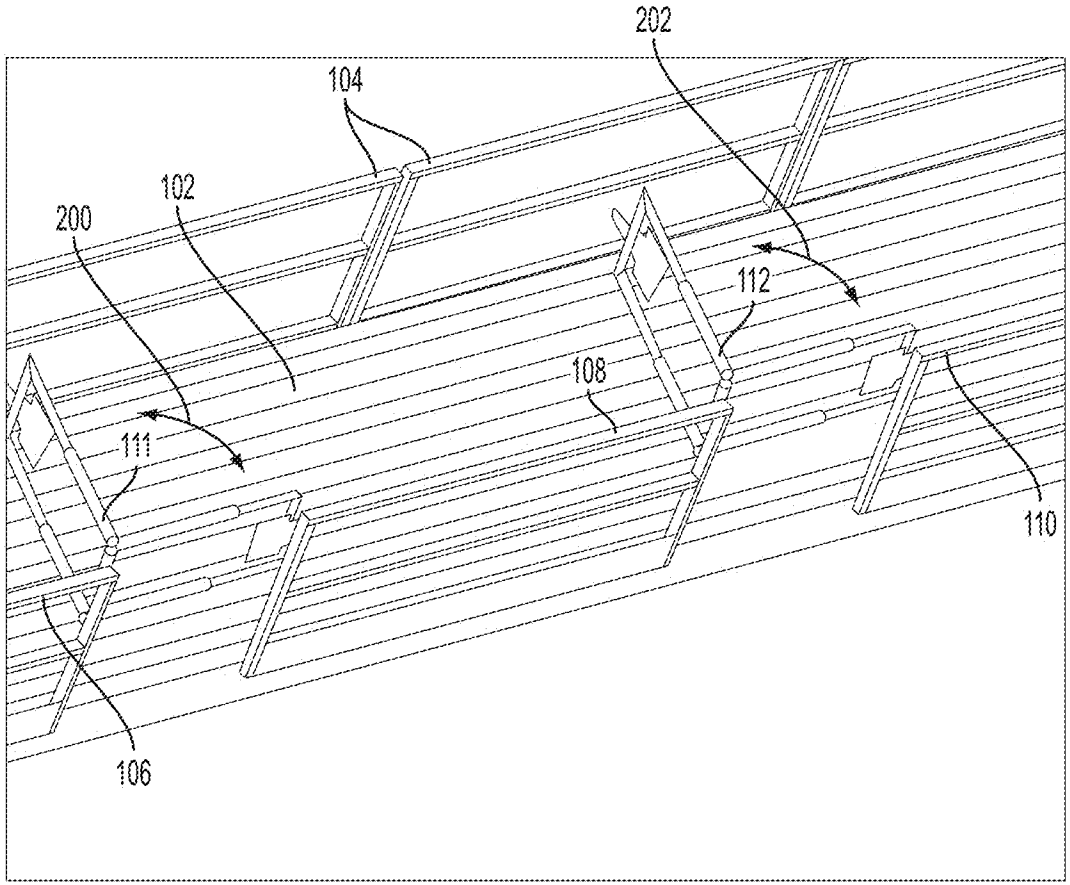

FIGS. 2A and 2B illustrate perspective views of the gangway of FIG. 1. As illustrated gate 111 may be a parallel-mounted gate and gate 112 may be a perpendicular-mounted gate. Parallel-mounted gate 111 may be aligned to be in line with handrails 106 and 108 such that parallel-mounted gate 111 is aligned (when closed) and disposed in the same plane that is defined by handrails 106 and 108. Perpendicular-mounted gate 112, on the other hand, may be such that the gate is (when closed) also parallel to handrails 110 and 108 but is shifted relative thereto such that perpendicular-mounted gate 112 is not disposed in the same plane that is defined by handrails 110 and 108. In this regard, as illustrated in FIG. 2A, the hinge of perpendicular-mounted gate 112 is mounted on the inside of the cage while the hinge of parallel-mounted gate 111 is mounted within the same plane that is defined by handrails 110 and 108.

Additionally, as illustrated in FIG. 2A, parallel-mounted gate 111 swings from a first position to a second position in the back-and-forth directions as referenced using numeral 200. The mounted hinge on the parallel-mounted gate 111 allows for the pivoting motion thereof in directions 200. Likewise, perpendicular-mounted gate 112 swings also from a first position to a second position in the back-and-forth directions as referenced using numeral 202. Perpendicular-mounted gate 112 also has a hinge which allows for such pivoting motion.

It should be understood that each gangway may include one or more perpendicular-mounted gates and/or one or more parallel-mounted gates. For example, as illustrated in FIG. 2A, one perpendicular-mounted gate 112 and one parallel-mounted gate 111 is employed. Additionally, FIG. 2B illustrates two perpendicular-mounted gates may be employed.

Figure 3:
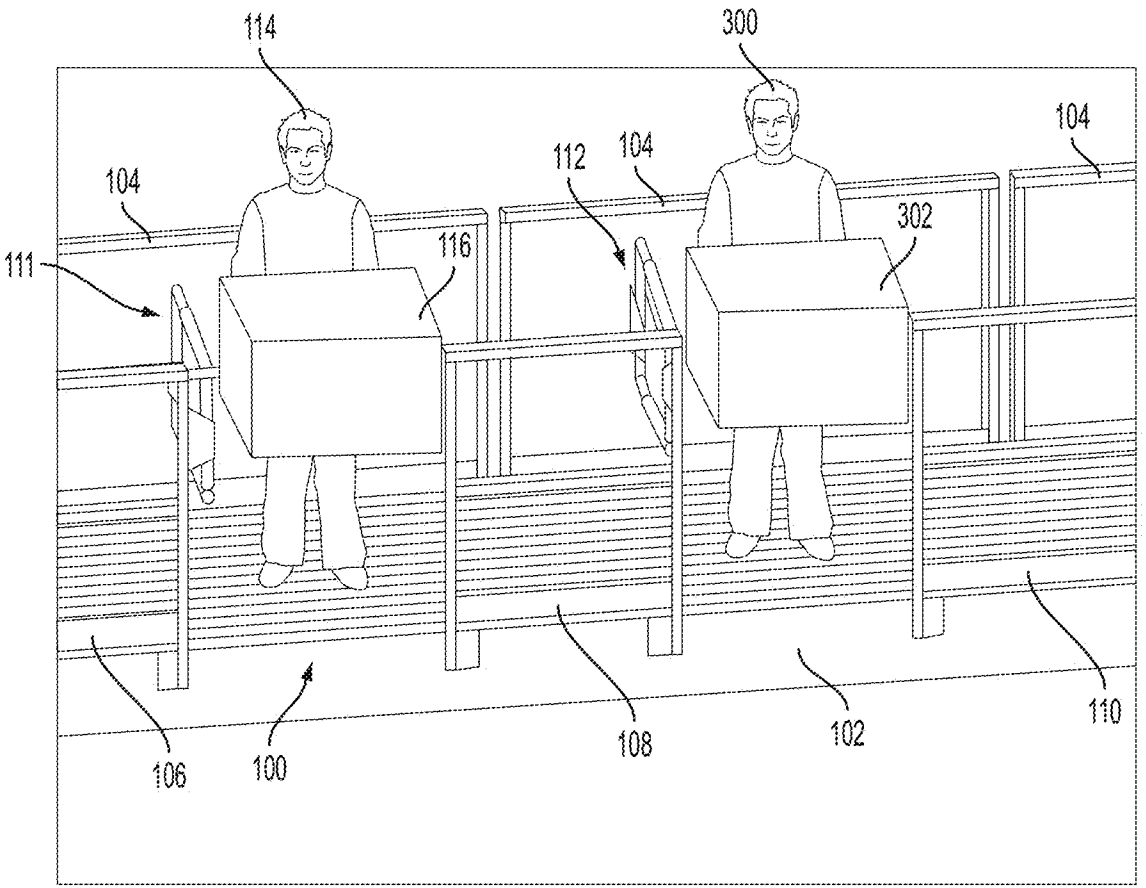
FIG. 3 is a perspective view showing the gates of FIGS. 1A and 1B swung into an open position.

FIG. 3 illustrates gates 112 and 111 that have been swung into an open position to create accessways through which users 114, 300 can access. Users 114, 300 are supported by platform 102 of the gangway and are carrying an object 116, 302 through each accessway. As shown the accessway is wide enough so that objects 116, 302 can traverse therethrough while a user stands on platform 102.

Figure 4A:
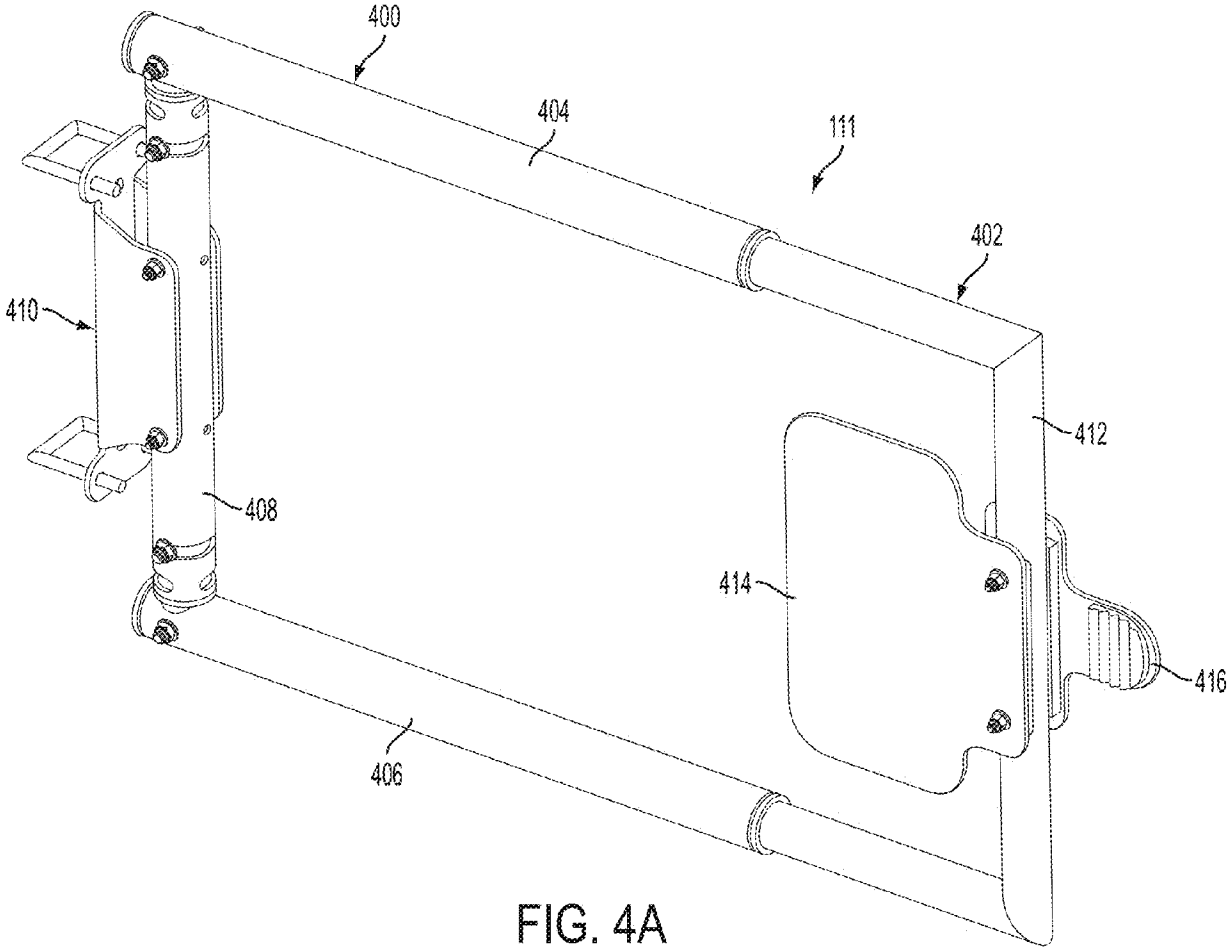
FIG. 4A is a perspective view of one of the gates of FIGS. 1A and 1B.
Figure 4B:
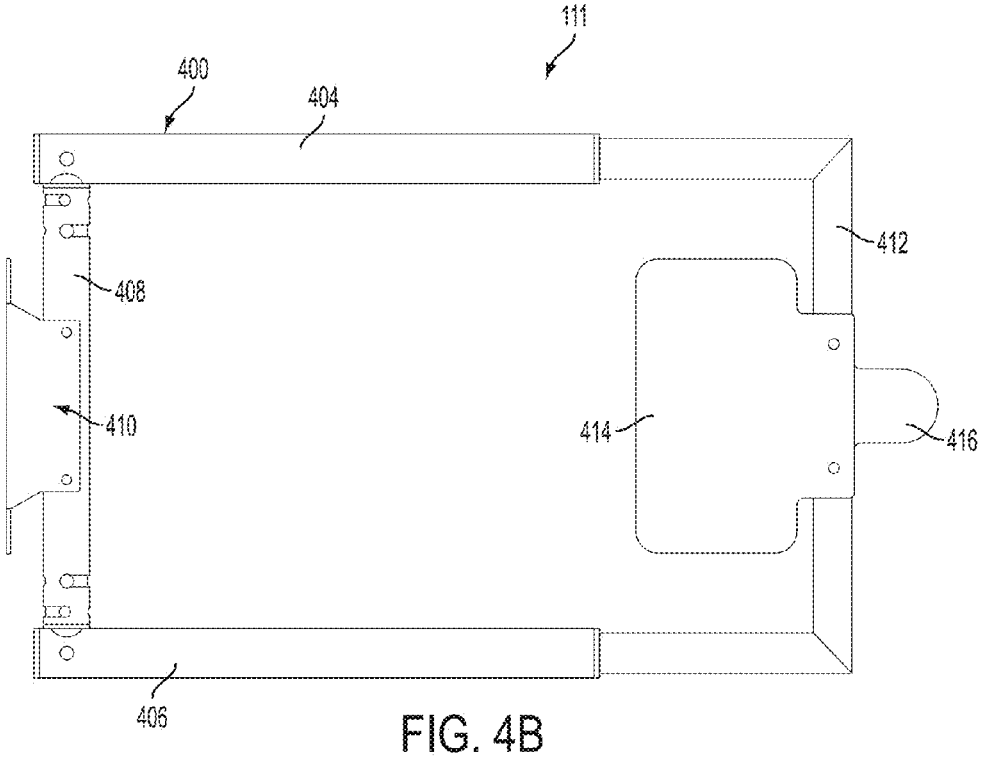
FIG. 4B is a side view of the gate of FIG. 4A.

FIG. 4A and FIG. 4B (collectively FIG. 4) illustrate the components of gate 111 according to an embodiment. Gate 111 includes a body 400 and a connecting system 410. The connecting system 410 connects the body to handrails of the gangway. The gate body 400 may include a hinge portion 408, supporting arms 404, 406, an adjustable arm member 402, and a stop system. Each of these components, as should be understood, may not be required to be a part of the system. For example, gate 111 may or may not include the stop system or the connecting system. Nonetheless, the above components is discussed in more depth below.

Figure 5A:
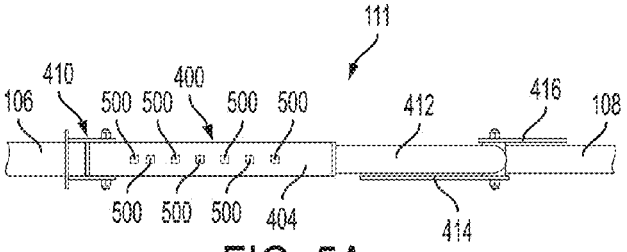
FIGS. 5A and 5B are top view of the gate of FIG. 4A adjusted differently.
Figure 5B:
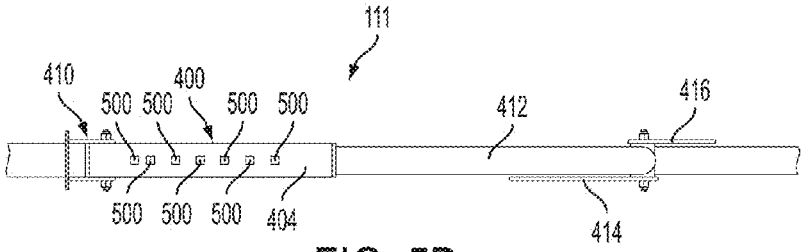
Figure 6A:
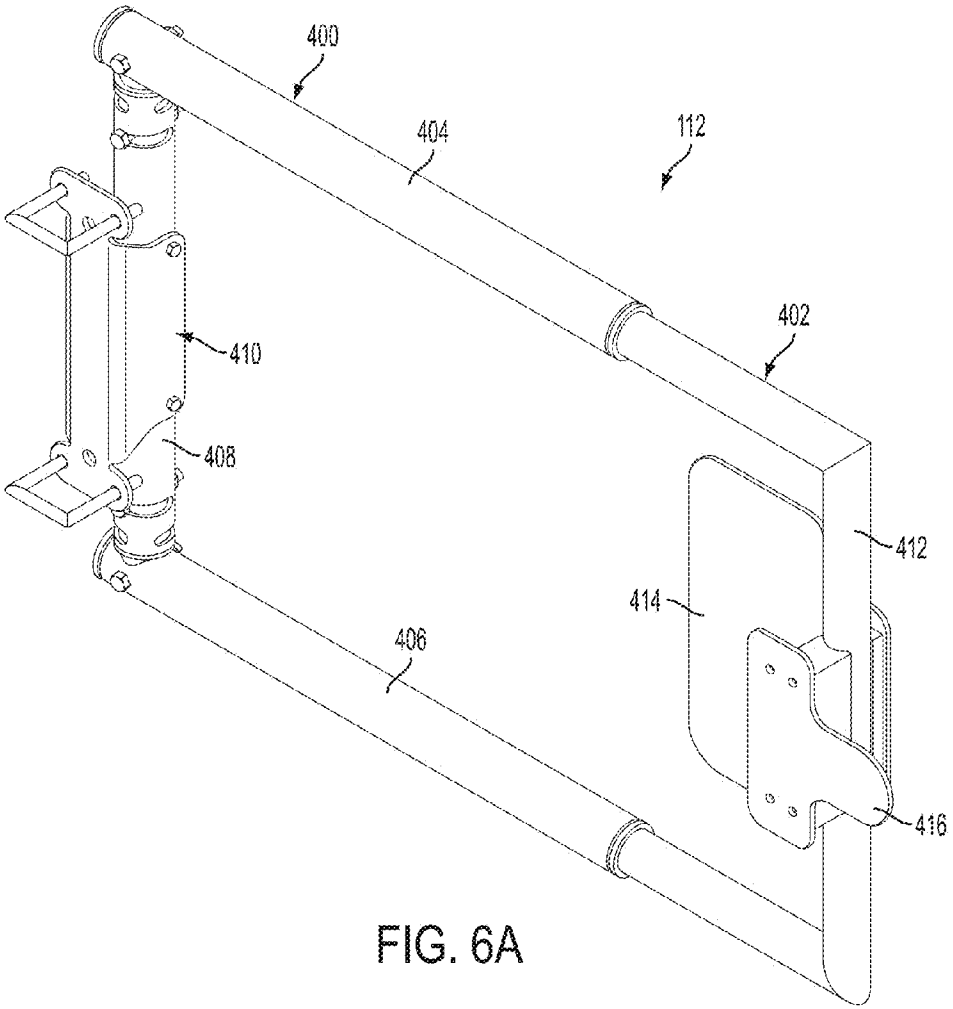
FIG. 6A is a perspective view of one of the gates of FIGS. 1A and 1B.
Figure 6B:
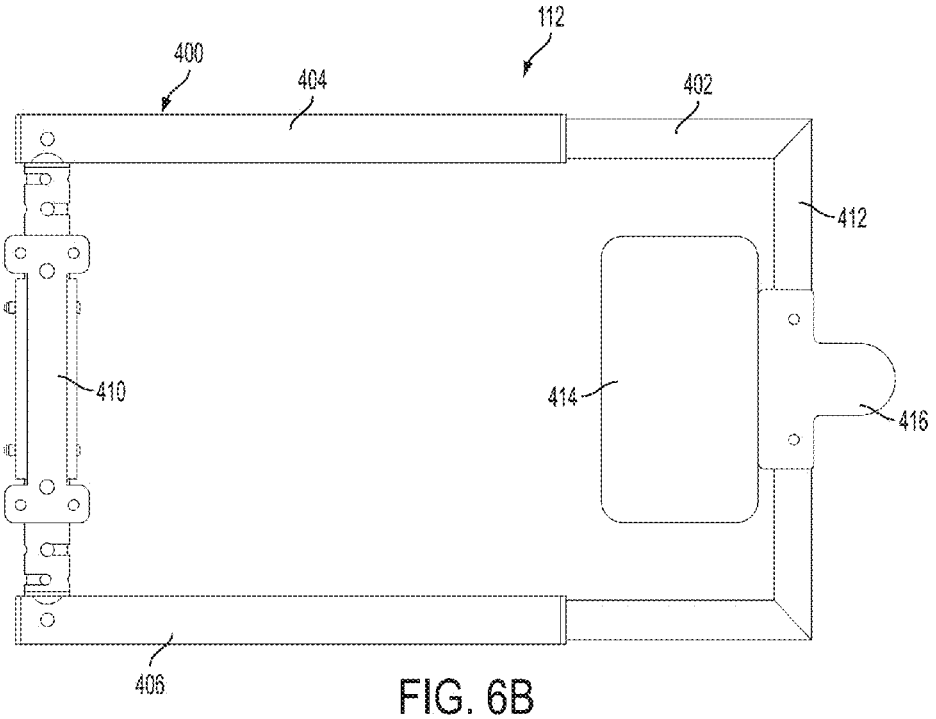
FIG. 6B is a side view of the gate of FIG. 4A.

The supporting arms 404, 406 may be a hollow tubular piece of continuous metal. These supporting arms 404, 406 are each configured to receive one end of adjustable arm member 402. As illustrated in FIGS. 5A and 5B, a bottom view of the parallel-mounted gate 111 is shown as attached to rail 106. Additionally, FIG. 5A illustrates gate 111 in a retracted position while FIG. 5B illustrates gate 111 in an extended position. As illustrated in FIGS. 5A and 5B, rails 106 and 108 define a plane such that gate 111 is disposed along such defined plane.

Continuing with FIGS. 5A and 5B, one or more supporting arms 404 (and/or 406) of gate 111 may include adjustment apertures 500. Each adjustment aperture 500 is spaced a distance along the longitudinal length of each supporting arm 404, 406. One or more ends of corresponding adjustment arms 412 have a mating member (not illustrated) which when positioned over an adjustment aperture mates with such aperture such that the adjustment arm 412 then locks into place relative to the supporting arms 404, 406. The adjustment arm may then be adjusted by moving the adjustable arm toward rail 106 or rail 108 to retract or extend, respectively, width of gate 111. In this regard, the mating member is positioned to another adjustment aperture 500 and when the appropriate gate width is reached, the mating member then mates with such adjustment aperture to lock the adjustable arm into position relative to the supporting arm 404, 406. In this manner gate 111 is adjustable. It should be understood that the adjustment apertures and mating member system should not be so limited and other adjustable systems may be employed.

Referring back to FIG. 4B, the hinge may include a rotatable member. In this regard, an inner hinge portion may be disposed in an outer hinge portion. The inner hinge portion may include one or more pins which protrude through a track defined in the outer hinge portion. This allows the outer hinge portion to rotate relative to the outer hinge portion. A spring is disposed within the inner and outer hinge portions so that when the gate 111 is swung open the spring exerts a force back onto gate 111 to close.

The stop system may include a base member 414 and a stop member 416. The base member 414 is configured to extend from the adjustable arm 412 toward the hinge. This allows a message to be displayed, to function as a handle or any other manner. The stop member 416 is configured to extend a distance away from the hinge and away from the end of the adjustable arm 412. This allows the stop member 416 to hit rail 108 so that gate 111 will rest against rail 108. Gate 111 therefore may only swing in one direction (e.g., toward the interior of the cage and not exterior to the cage).

Figure 7A:
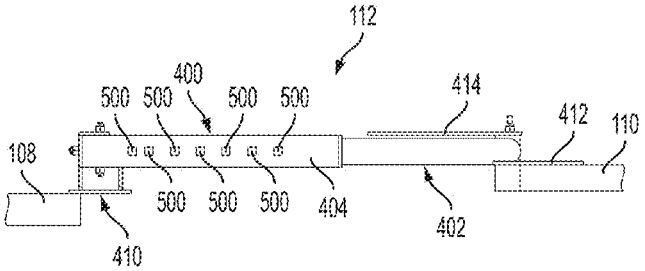
FIGS. 7A and 7B are top view of the gate of FIG. 4A adjusted differently.
Figure 7B:
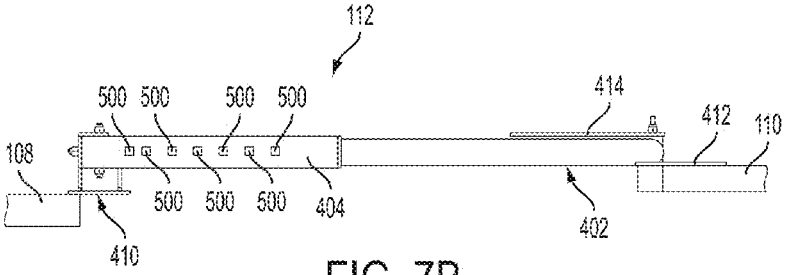

FIGS. 6A, 6B, 7A and 7B are illustrations of the perpendicular-mount gate 112. Similar to the parallel-mount gate 111, perpendicular-mount gate 112 also includes a the stop system (including stop member 416 and base member 414), apertures 500, hinge, supporting arms 404, 406 and adjustable arm member 402, according to an embodiment. In this regard, perpendicular-mount gate 112 may be similar to parallel-mount gate 111 except the manner in which perpendicular-mount gate 112 is mounted to rail 108. As illustrated in FIGS. 7A-B, perpendicular-mount gate 112 is mounted to rail 108 so that perpendicular-mount gate 112 is offset therefrom. As such, perpendicular-mount gate 112 is offset and therefore does not reside in an extended longitudinal plane defined by rail 108 or the plane defined between rails 108 and 110.

Figure 8:
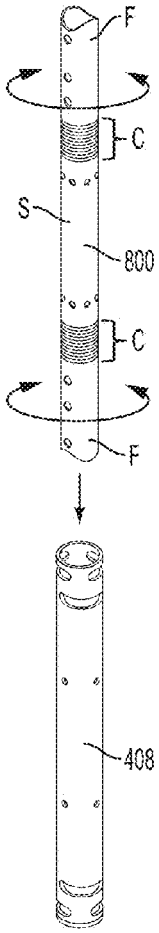
FIGS. 8, 9, 10, 11A and 11B are perspective view showing assembly of various components of a gate in accordance with the present invention.
Figure 9:
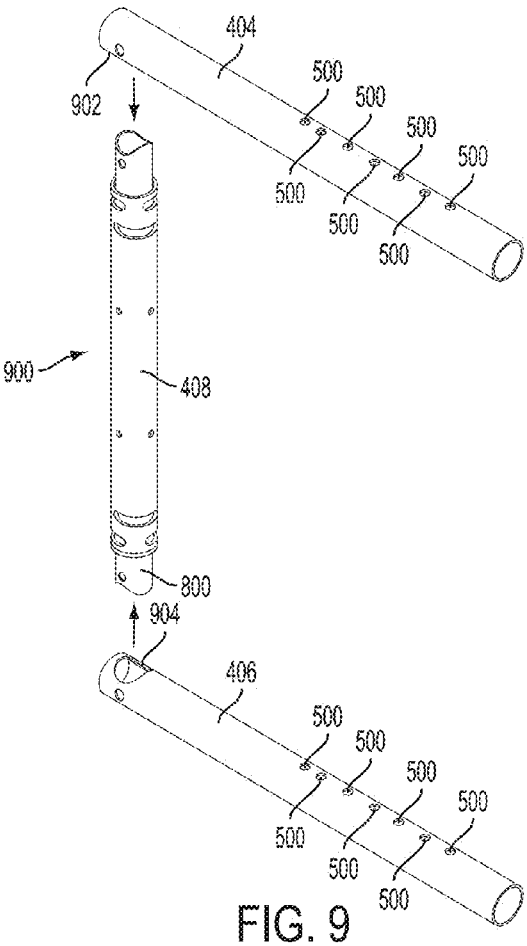

FIGS. 8-9 illustrate exploded views of some of the components of a gate (whether the gate is perpendicular-mount gate 112 or parallel-mount gate 111) according to an embodiment. As illustrated, each gate may include supporting arms 404, 406 and hinge system 900. As mentioned above supporting arms 404, 406 may be a tubular piece of continuous metal. The supporting arms 404, 406 may have apertures 500 along a portion thereof in which these apertures may be defined in the supporting arms 404, 406 in a straight line.

The hinge system 900 may include an outer hinge portion 408 and an inner hinge portion 800. Outer hinge portion and inner hinge portion 800 may both be a tubular piece of metal. The outer hinge portion 408 is configured to receive the inner hinge portion 800. In this regard, the outer hinge portion 408 is hollow and has an interior cavity. The interior cavity of outer hinge portion 408 has a diameter that is greater than or equal to the diameter of inner hinge portion 800. This allows inner hinge portion 800 to be completely inserted into the interior cavity of outer hinge portion 408. The inner hinge portion 800 and outer hinge portion 408 will now be described below according to some embodiments.

The tubular piece of metal of inner hinge portion 800 may be scored or cut (at a "cut location" labeled C) so that a first portion F of the inner hinge portion 800 can rotate relative to a second portion S of the inner hinge portion 800, as indicated by the arrows. As shown in FIG. 8, two such cut locations C are defined in inner hinge portion 800 such that upper and lower first portions F may rotate with respect to second portion S. When the first portion F of inner hinge portion 800 does rotate relative to the second portion S of inner hinge portion 800, potential energy is created so that a force is exerted on both the first and second portions of the inner hinge portion 800 in a direction to rotate the first and second portions back to the original home or rest position. The inner hinge portion 800 may have one or more scores or cuts to vary the rotational forces on the inner hinge portion 800.

Figure 14A:
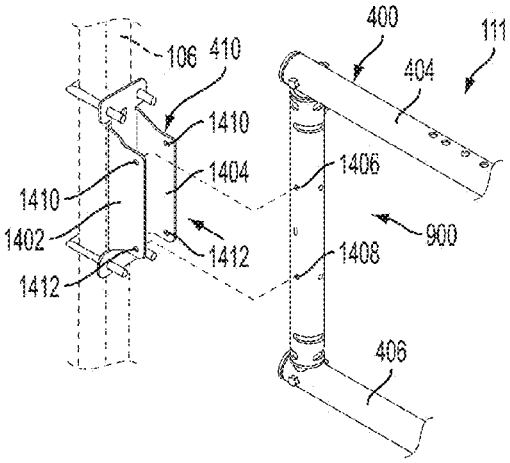
Figure 14B:
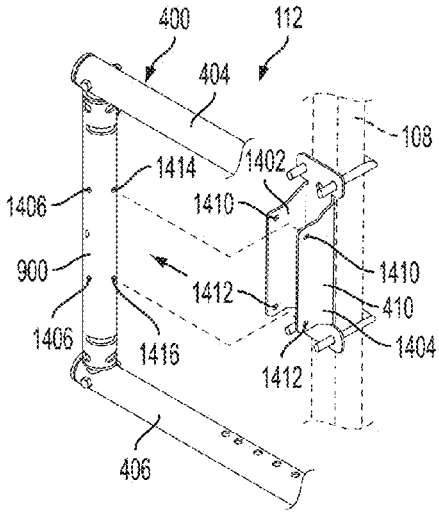
Figure 14C:
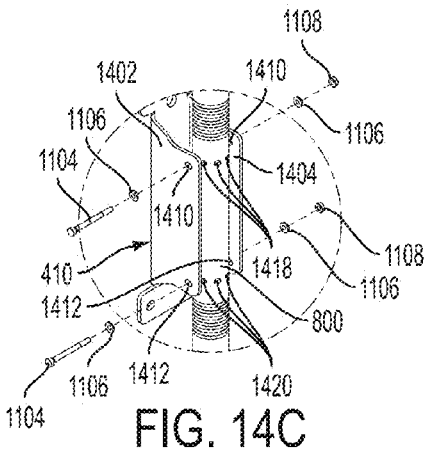
Figure 14D:
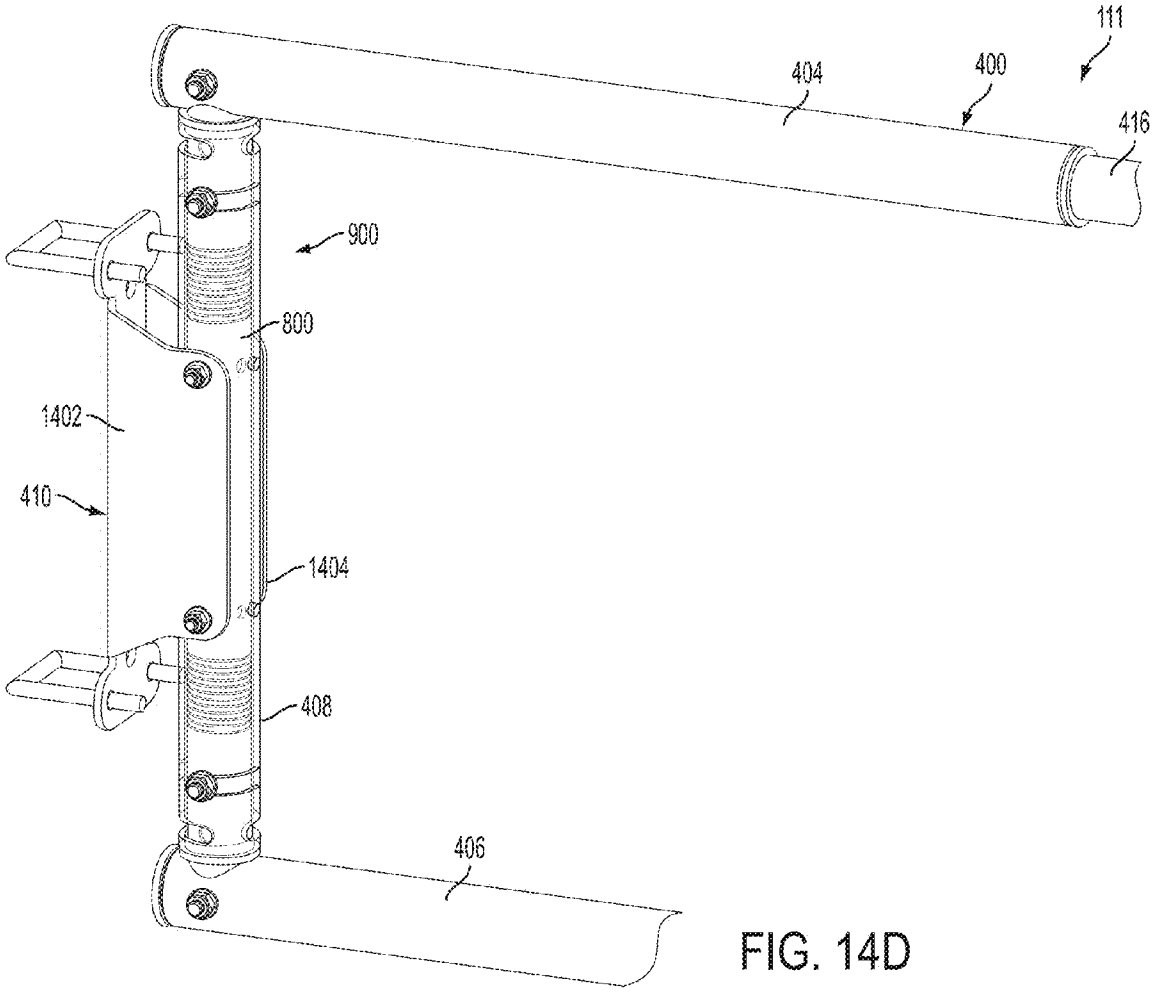

Additionally, inner hinge portion 800 may include at least one pin to be attached thereto as illustrated in FIG. 14D. The pin protrudes through a slot of outer hinge portion 408. The slot is a predefined length and is defined in outer hinge portion 408 in a direction that is in a plane defined by the direction 202 or 200 (i.e., the direction the gate swings in). The slot therefore is configured to only allow the inner hinge portion 800 to rotate a certain degree relative to the outer hinge portion 408. FIG. 8 illustrates the slot being on both ends of the outer hinge portion 408. Additionally, FIG. 8 illustrates that inner hinge portion 800 includes a hole where a pin may be inserted at various locations about the periphery of the inner hinge portion 800. This allows for the location of the pin to be variable to adjust the closing force of hinge 900. It should be understood that the pin and slot system of hinge 900 could be replaced with any other system to facilitate operation of hinge 900. Additionally, it should be understood that the pin may be affixed to inner hinge portion 800 instead of being inserted into a hole in inner hinge portion 800.

Inner hinge portion 800 also includes a first end and second end. At the first and second ends of the inner hinge portion 800, an attachment system is defined or disposed in the inner hinge portion 800 so that the inner hinge portion 800 is fixably attached to the supporting arms 404, 406. For example, as illustrated in FIG. 9, at a first end of inner hinge portion 800 an aperture is defined in inner hinge portion 800 which mates with an aperture in supporting arm 406. The first end of inner hinge portion 800 is inserted into a hole 1008 (see FIG. 10) of supporting arm 406 so that the aperture of inner hinge portion 800 aligns with the aperture of supporting arm 406. A connecting member (shown in FIG. 11B as pin 1104) may then be inserted into the aligned apertures 1100 to fix the first end of inner hinge portion 800 to supporting arm 406 (and a washer 1106 and nut 1108 may be used to secure the pin 1104 in such aperture). The same operation occurs for the opposite end of inner hinge portion 800 and supporting arm 404 so that the opposite end of inner hinge portion 800 is fixably attached to supporting art 404. As such, arm 404 and arm 406 are fixably attached to inner hinge portion 800.

Figure 10:
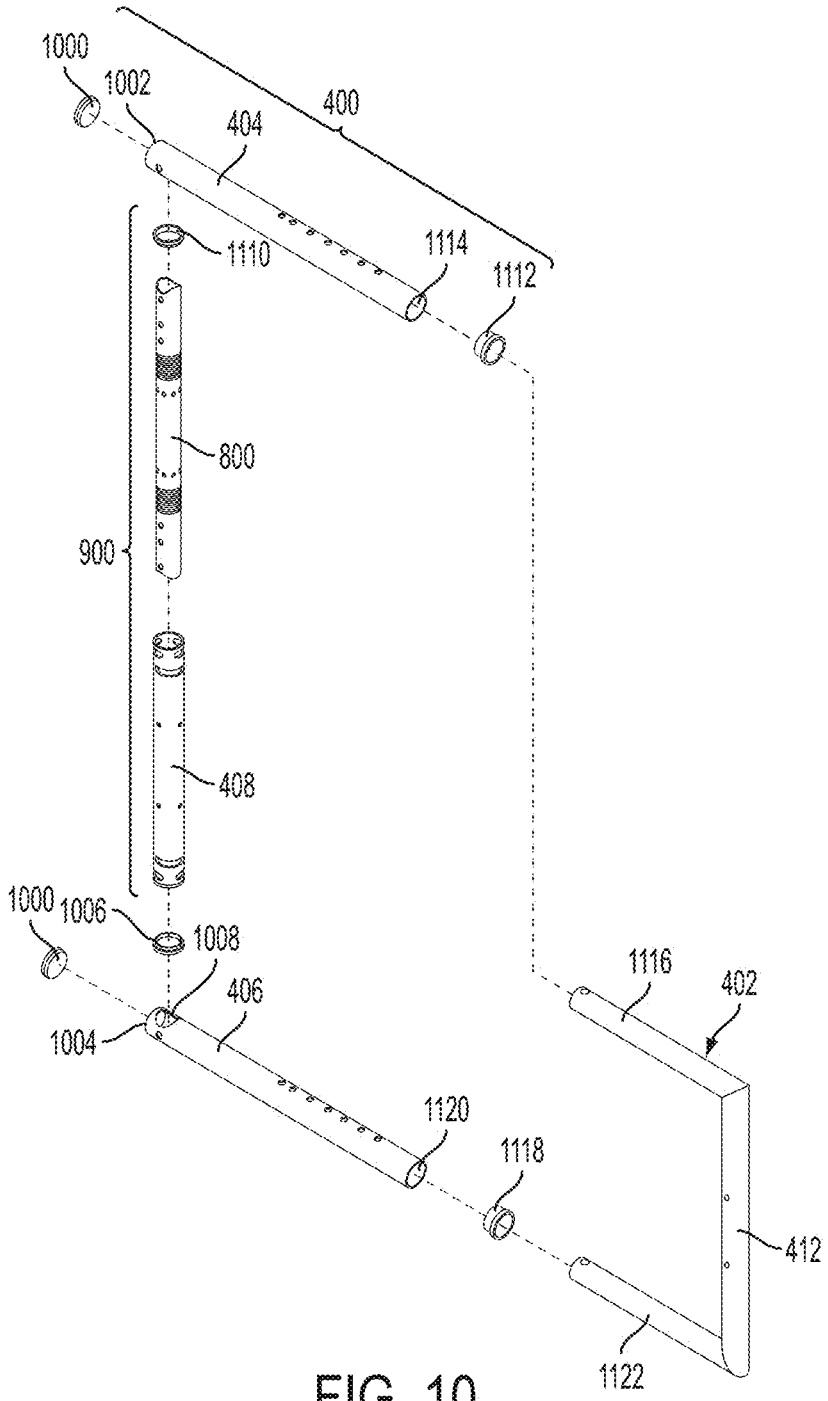

In one embodiment, as illustrated in FIG. 10, a washer 1006 and 1110 may be inserted into the first and second ends (respectively) of inner hinge portion 800 prior to affixing the first and second ends of inner hinge portion 800 to the supporting arms 404, 406. Additionally, caps 1000 may be inserted at the proximate ends 1002, 1004 of supporting arms 404, 406.

Additionally, as illustrated in FIG. 10, after the hinge is fixed to the supporting arms 404, 406, adjustable arm member 402 is then adjustably (and optionally releasably) attached to the supporting arms 404, 406. In this regard, a first end 1116 of adjustable arm member 402 is inserted into an opening 1114 of supporting arm 404. It should be noted that a washer may be inserted into opening 1114 prior to inserting first end 1116 into opening 1114. Regardless, the adjustable arm member 402 is adjustably attached to the supporting arms 404, 406 by aligning a spring-loaded pin (not shown) at the end of each end 1116 and 1122 with one of the apertures 500 of each supporting arm 404, 406. This allows the spring loaded pin to be disposed in such aligned aperture 500, thereby securing each end at such aperture. For example, at end 1116 a spring-loaded pin is disposed (either being permanently attached or removably attached) at end 1116. When end 1116 is inserted into supporting arm 404, the spring loaded pin at end 1116 then is positioned at one of the apertures 500 of supporting arm 404. The spring loaded pin then is inserted into the desired aperture 500 so that the length of the gate covers the accessway between rail 108 and 110. The same happens for the other end 1122 of adjustable arm 402 with respect to supporting arm 406. In this regard, the adjustable arm member 402 is adjustable by allowing the spring-loaded pin to be moved to other apertures so that ends 1116 and 1122 move in and out of the interior cavities of supporting arms 404 and 406. This adjusts the overall length from the hinge 900 to the end 412 of adjustable arm member 402.

While hinge system 900 is described above and illustrated in the figures as being the hinge of the gates, it should be understood that any other hinge system may be employed instead of hinge system 900 so as to allow supporting arms 404, 406 (as well as adjustable arm member 402) to rotate relative to rail 108.

Figure 11A:
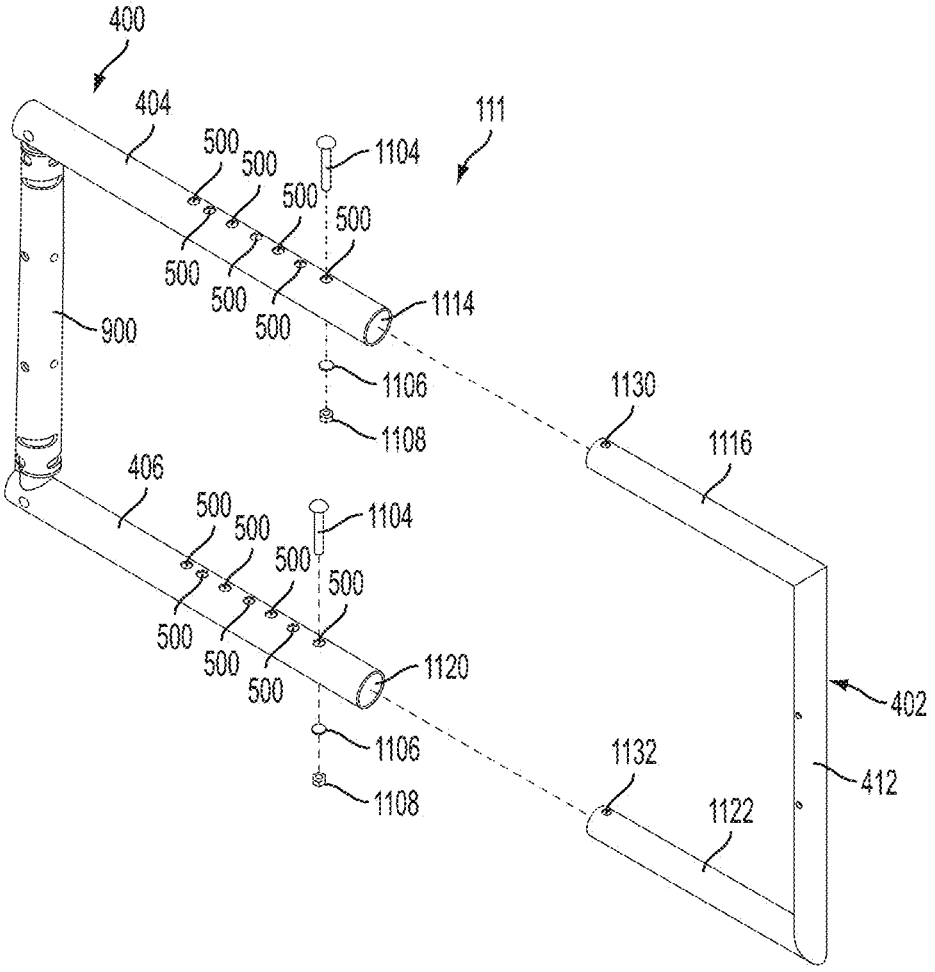
Figure 11B:
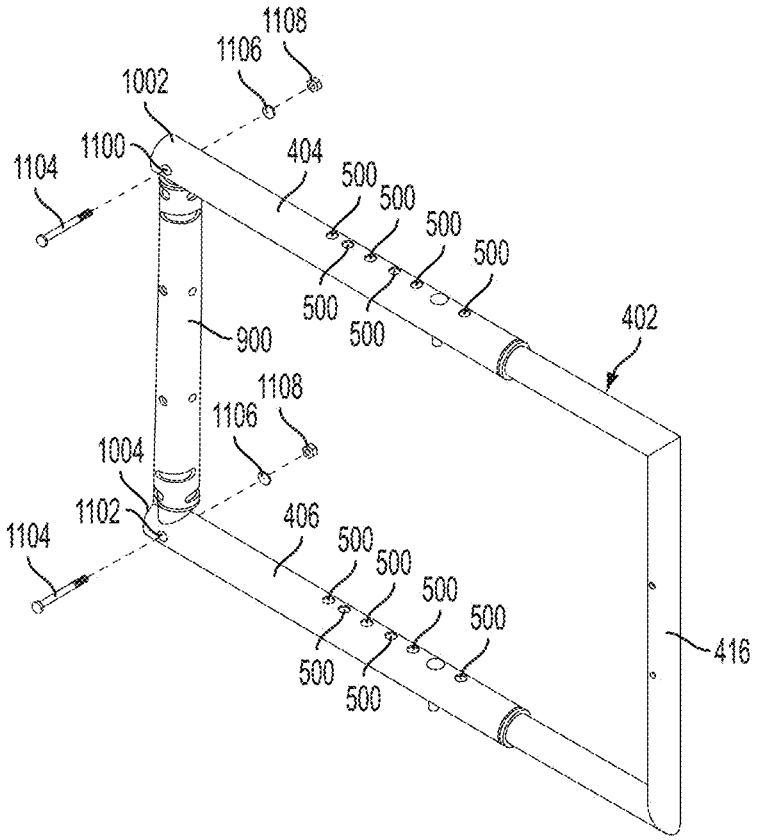

It should be understood that a spring-loaded pin not be required for the gate to be adjustable. The pin may not be fixed to adjustable arm member 402 and as such may be a fixable member, such as a cotter pin, a straight pin or other device which is simply inserted in an aligned aperture 500 defined in arm 404, 406 and hole 1130, 1132 defined at end 1116, 1122 respectively. For example, as illustrated in FIG. 11A, a straight pin 1104 is inserted into aperture 500 of supporting arm 404 when aperture 1130 is aligned therewith when end 1116 of adjustable arm member 402 is inserted into supporting arm 404. Likewise, another straight pin 1104 is inserted into aperture 500 of supporting arm 406 when aperture 1130 is aligned therewith when end 1122 of adjustable arm member 402 is inserted into supporting arm 406. Each pin is inserted into the respective apertures (500 of 404 and 1130; 500 of 406 and 1132) so that the pin traverses the diameter of supporting arms 404, 406. A washer 1106 and nut 1108 (or other locking system) attaches to the end of each pin 1104 to keep pin 1104 in place thereby locking adjustable arm 402 into place. As indicated above, the pin 1104 can be removed and then adjustable arm member 402 can be inserted into supporting arms 404, 406 more or slide outwardly from supporting arms 404, 406 to adjust the total length of the gate. After adjustment to the appropriate length, the pin 1104 is then inserted into another aperture 500 for each supporting arm 404, 406.

It should be noted that any other securing mechanism may be employed instead of a pin and aperture system and the present invention should not be limited, as discussed later with regard to FIGS. 16-19.

Figure 12A:
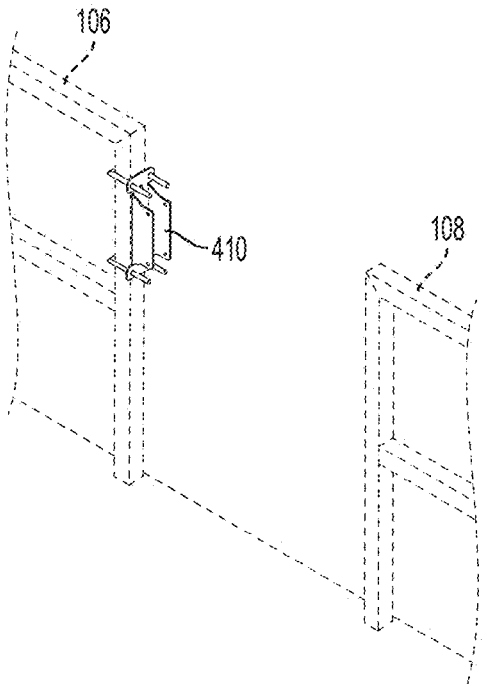
FIGS. 12A-12B, 13A-13C and 14A-14F show various hinge arrangements and related components for swing mounting of the gate.
Figure 12B:
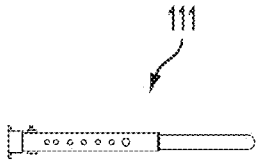
Figure 13A:
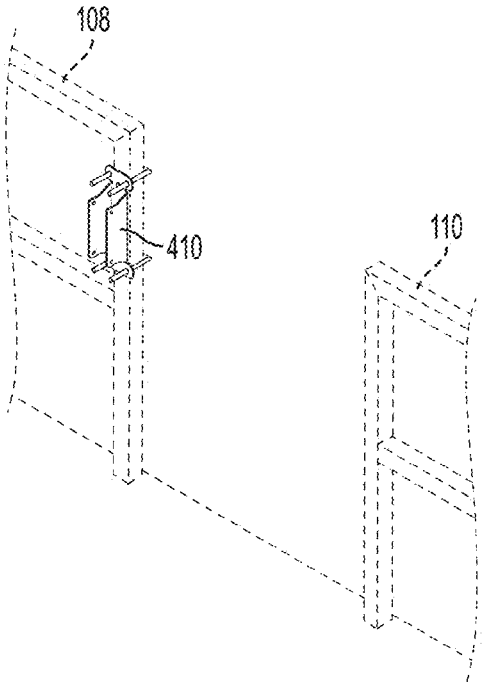
Figure 13C:
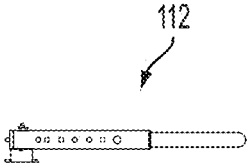
Figure 13B:
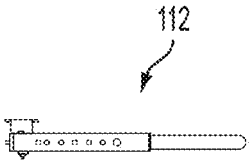

FIGS. 12-14 illustrate the hinge system 900 being connected to rail 108. FIGS. 12A, 12B, and 14A illustrate a gate being parallel mounted to rail 108 and FIGS. 13A, 13B, 13C and 14B illustrate a gate being perpendicular-mounted to rail 108. Starting first with FIGS. 12A and 12B, a bracket 410 is mounted to rail 108 so that bracket 410 is disposed in the accessway between rail 108 and 110. It is noted that FIG. 12B illustrates a top view of gate 111 installed parallel-mounted to rail 108. As illustrated, gate 111 is installed so that the longitudinal length of gate 111 extends in a direction that extends away directly from bracket 410 so that gate 111 is in the same longitudinal plane that rail 108 and rail 110 is in.

FIG. 13A illustrates bracket 410 mounted perpendicularly to rail 108 such that bracket 410 faces perpendicular to the plane defined by the area between rails 108 and 110. This allows gate 111 to still be in a plane that is parallel to the plane defined between rails 108 and 110 but shifted a distance therefrom. This is illustrated by FIGS. 13B-C which is a top view of perpendicular-mounted gate 112.

FIGS. 14A-C illustrate how gate 111 and 112 attach to bracket 410. As illustrated the bracket is respectively mounted to rail 108 using a base bracket and pins which surround rails 106, 108 so that bracket member 1410 is fixably secured to rail 106 or 108. Bracket 410 includes two side portions 1402 and 1404 which receive hinge 900. Apertures 1410 and 1412 align with apertures 1406 and 1408 respectively (or 1414 and 1416, respectively) of outer hinge portion 408 and an opposed pair of apertures 1418 and 1420 of inner hinge portion 800. Pins are disposed between such aligned apertures as illustrated in FIGS. 14A-B. When the pins are inserted therein and attached therethrough using washer 1106 and nut 1108 as illustrated in FIG. 14C, the hinge and therefore the gate is then fixably and rotatably attached to rail 106 or 108.

Figure 14E:
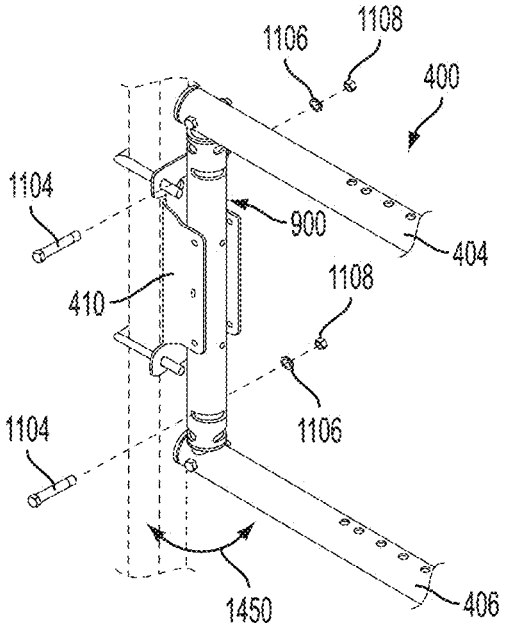
Figure 14F:
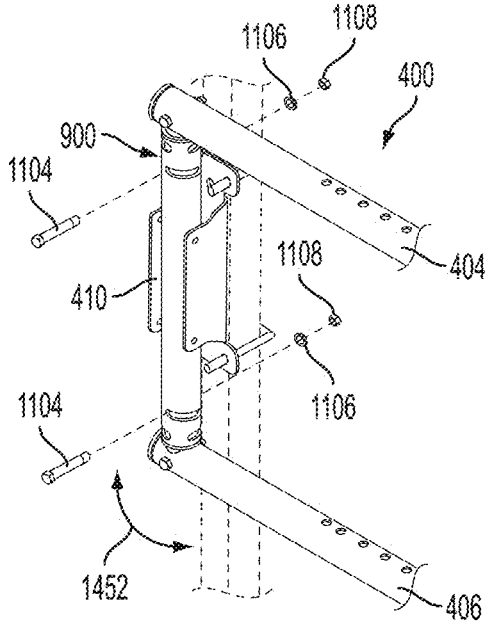

FIGS. 14E-F illustrate operation of the gate. As illustrated pins 1104 are inserted into hinge system 900 so that the pins protrude through tracks in the outer hinge portion. The gate is allows to swing in the direction shown by 1450 and 1452 in the parallel mount gate and perpendicular mount gate, respectively. As previously discussed, as the gate is swung open, a first portion of the inner hinge portion rotates relative to a second portion of the inner hinge portion, thereby creating a force to revert the first and second portions of the inner hinge portions to rotate back to the initial position prior to opening the gate. When the gate is therefore released, the gate swings back to the original position at rest.

Figure 15A:
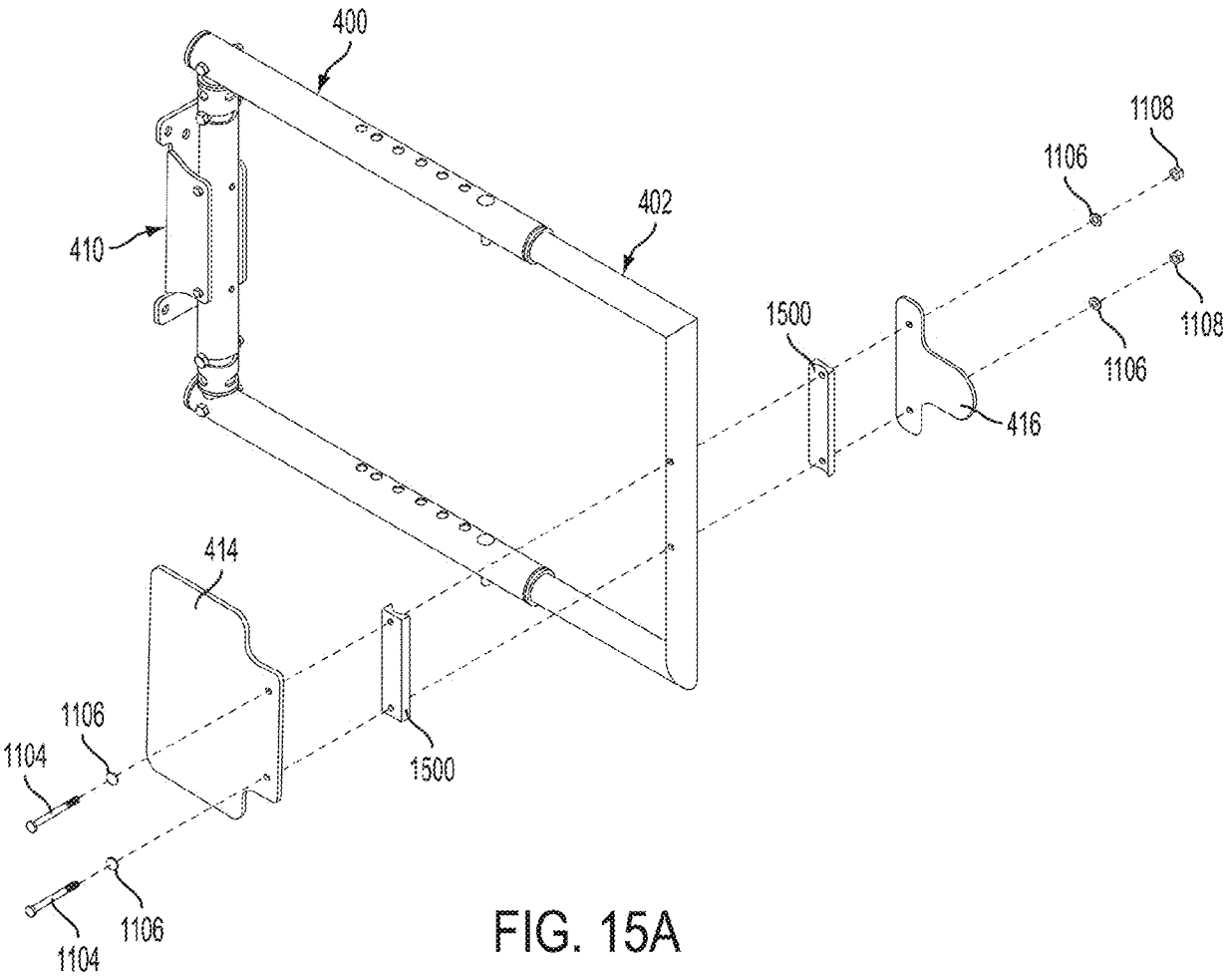
FIGS. 15A-15B illustrate installation of a stop system for the gate in accordance with an embodiment.
Figure 15B:
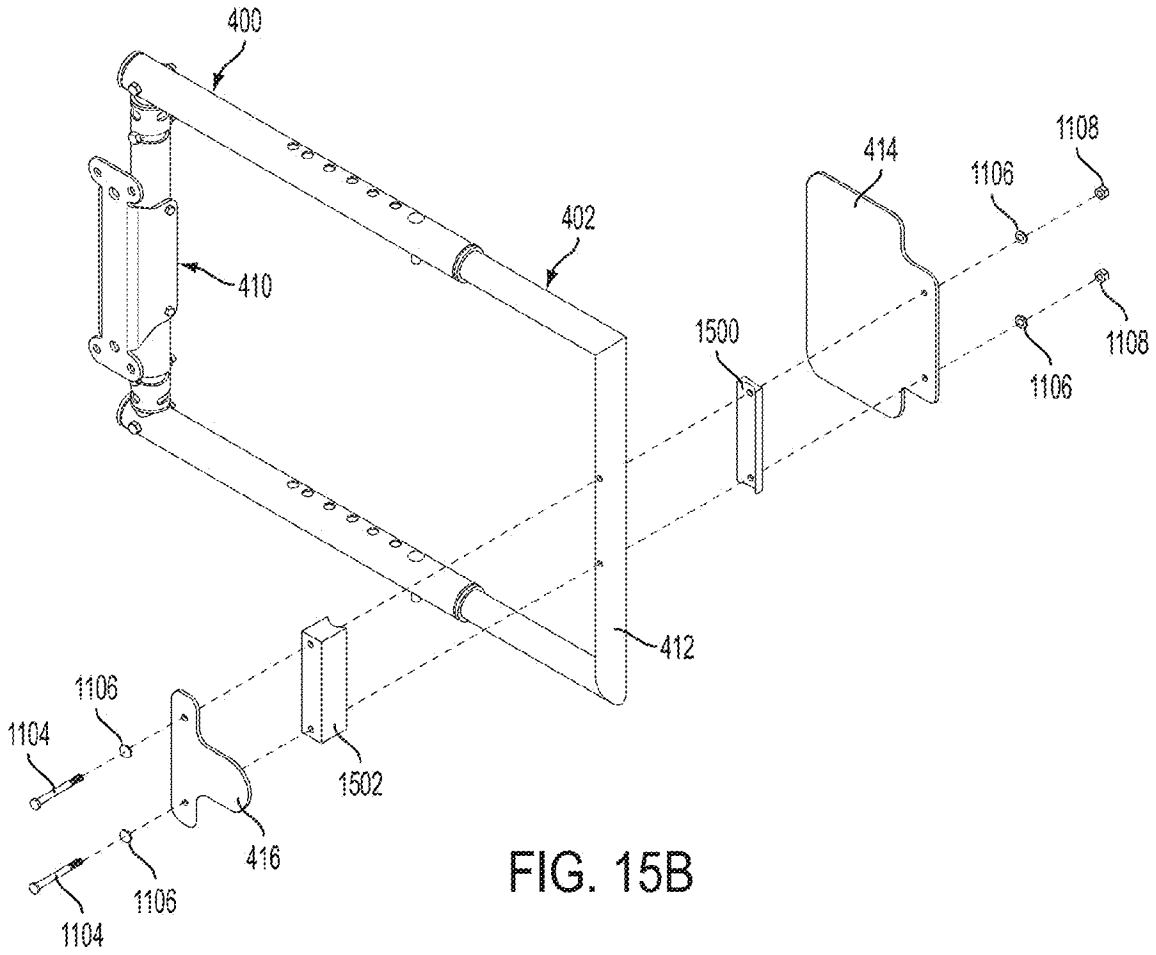

FIGS. 15A-B illustrate the installation of the stop system. Stop member 416 is attached to a plate 1500 and base member 414 is attached to another plate 1500. Stop member 416 with plate 1500 is then attached to the end of the gate at the adjustable arm portion as well as base member 414 being attached another plate 1500.

Figure 16:
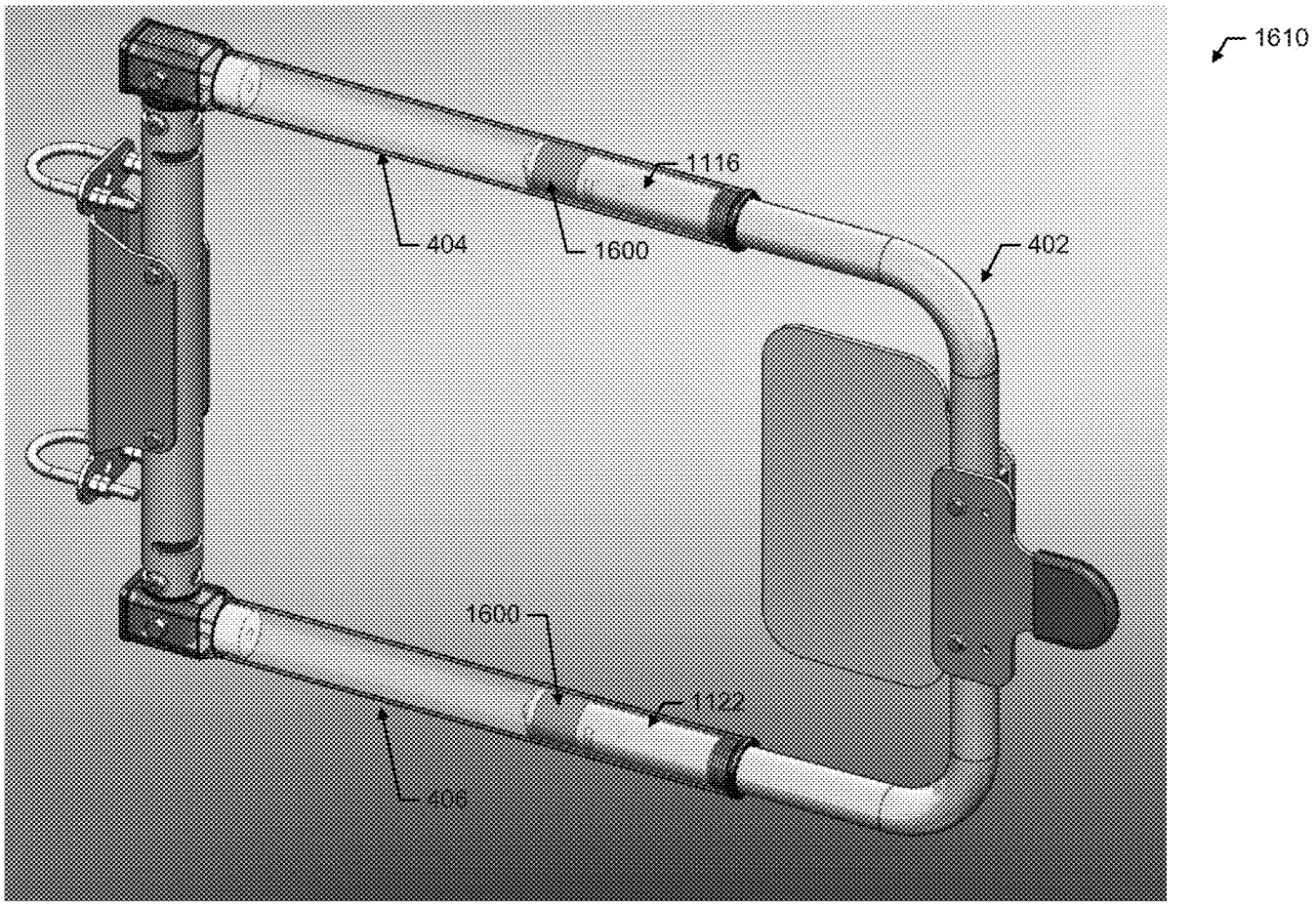
FIG. 16 is a perspective view of a gate in accordance with another embodiment of the present invention.

FIG. 16 illustrates a perspective view of gate 1610 according to another embodiment of the present invention. Gate 1610 includes elements similar to gate 111 as discussed above. However, the adjustable arm member 402 has a different means to adjust the length of gate 1610 as opposed to gate 111. In this regard, gate 1610 includes a compression member 1600 at the end of end 1116 and end 1122 of adjustable arm member 402. The compression member 1600 may be made of rubber or other material which can compress and when compressed with a surface creates a large enough amount of friction with such surface so that the compression member does not substantially move from such surface. In one embodiment, the compression member 1600 is a rubber washer or tube which is wrapped around both ends 1116, 1122 of adjustable arm member 402. Compression member 1600 is adjustable and is in a resting state initially such that the diameter of compression member 1600 is less than the diameter of the hollow interior cavity of supporting arm 404. As such, compression member 1600 is able to be slid into the hollow interior cavity easily.

Figure 17A:
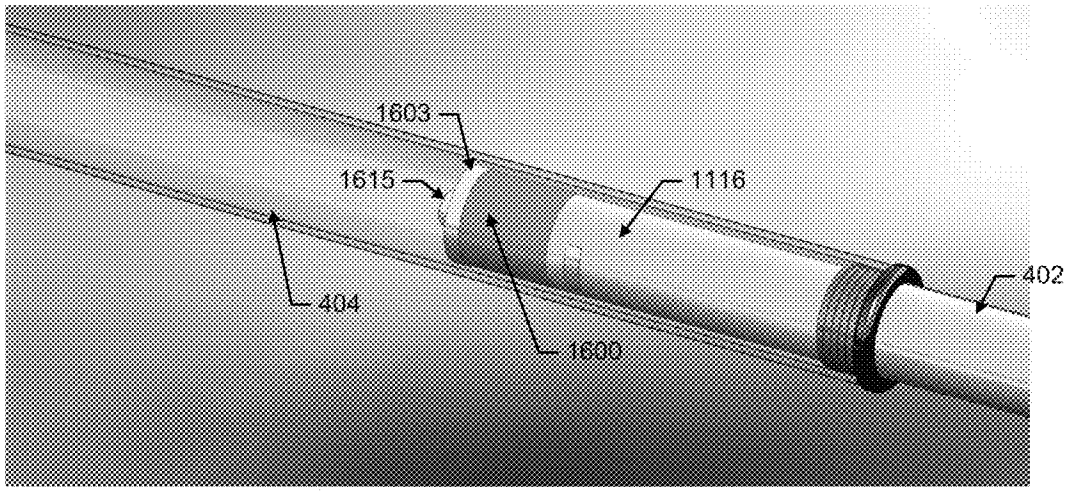
FIGS. 17A-17B are enlarged views, partially in phantom, showing an adjustment mechanism for the gate of FIG. 16.
Figure 17B:
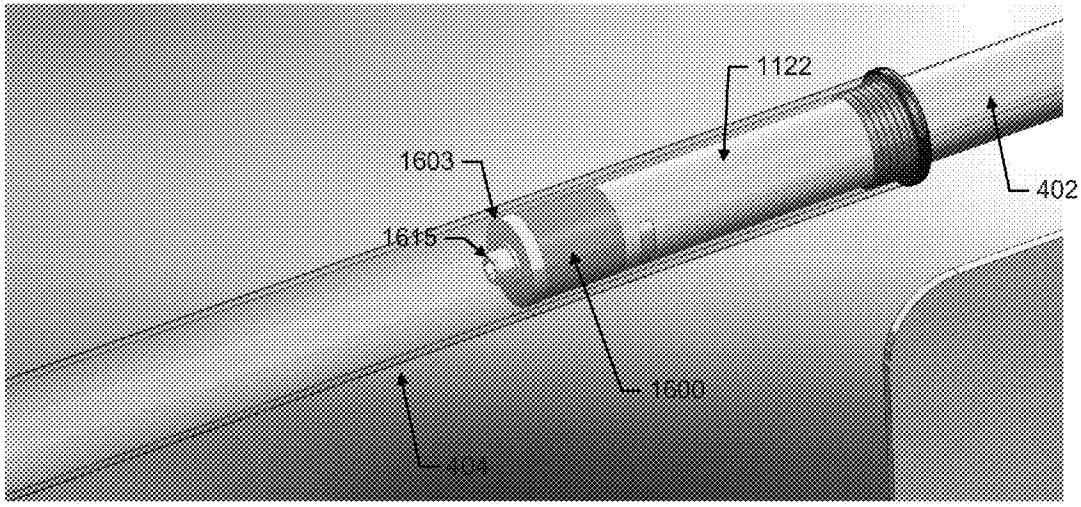

As illustrated in FIG. 17, a compression fitting 1603 is attached to the end of both ends 1116 and 1122 of adjustable arm member 402. The compression member 1600 is wrapped around the compression fitting 1603. Compression fitting 1603 is configured to compress compression member 1600 (and/or increase the diameter of compression member 1600) when the screw portion 1615 is turned. This increases the diameter of the compression fitting disposed underneath compression member 1600 so that compression member 1600 expands to have a larger diameter.

Figure 18A:
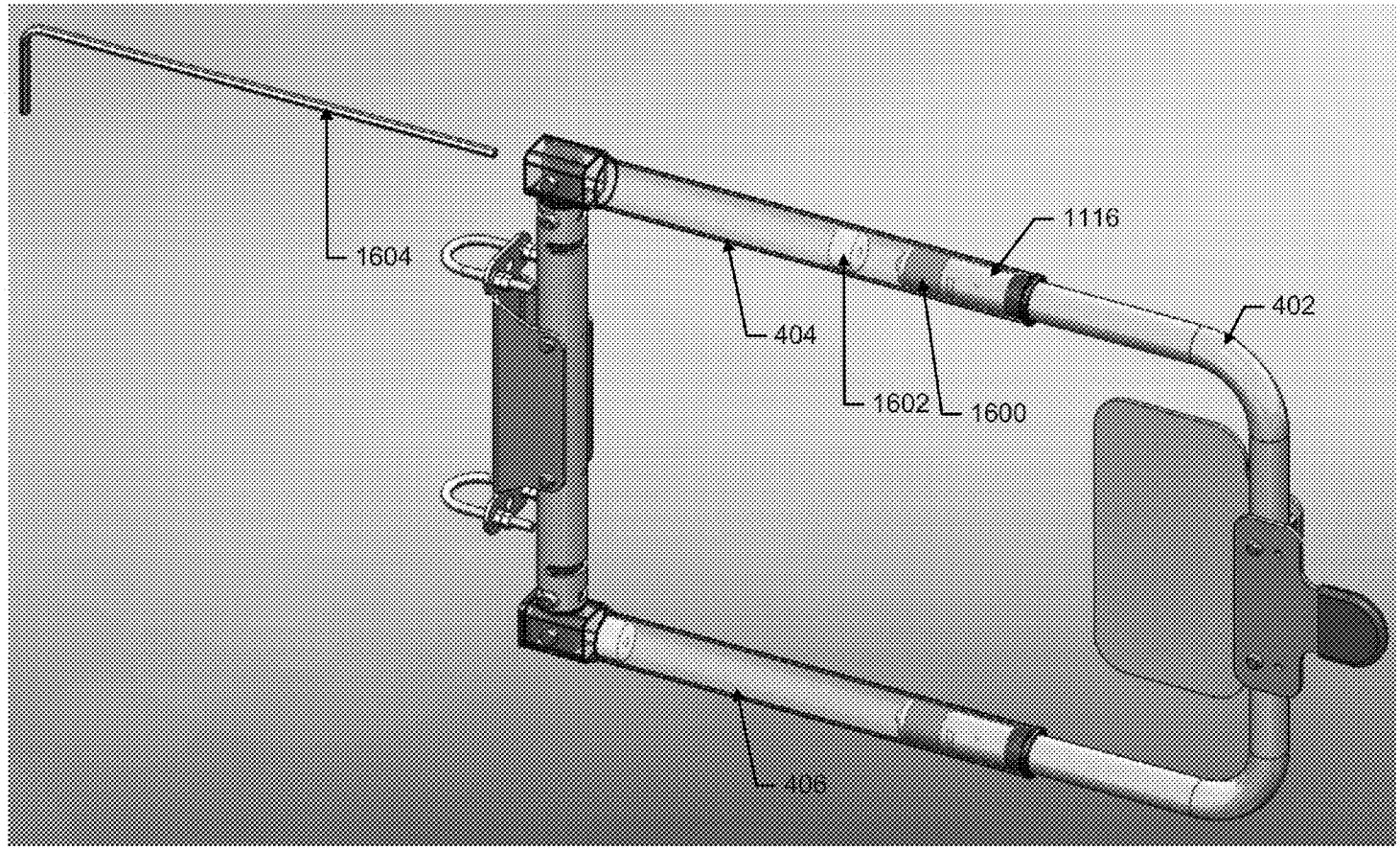
FIGS. 18A-18B and 19A-19B show operation of the adjustment mechanism of FIGS. 17A-17B.

FIG. 18A illustrates a tool 1604, such as an allen wrench, which is configured to be inserted into the hollow interior cavity of supporting arm member 404 at an opening proximate to hinge 900 according to one embodiment. The tool 1604 is shaped to mate with screw portion 1615 of compression fitting 1603.

Figure 18B:
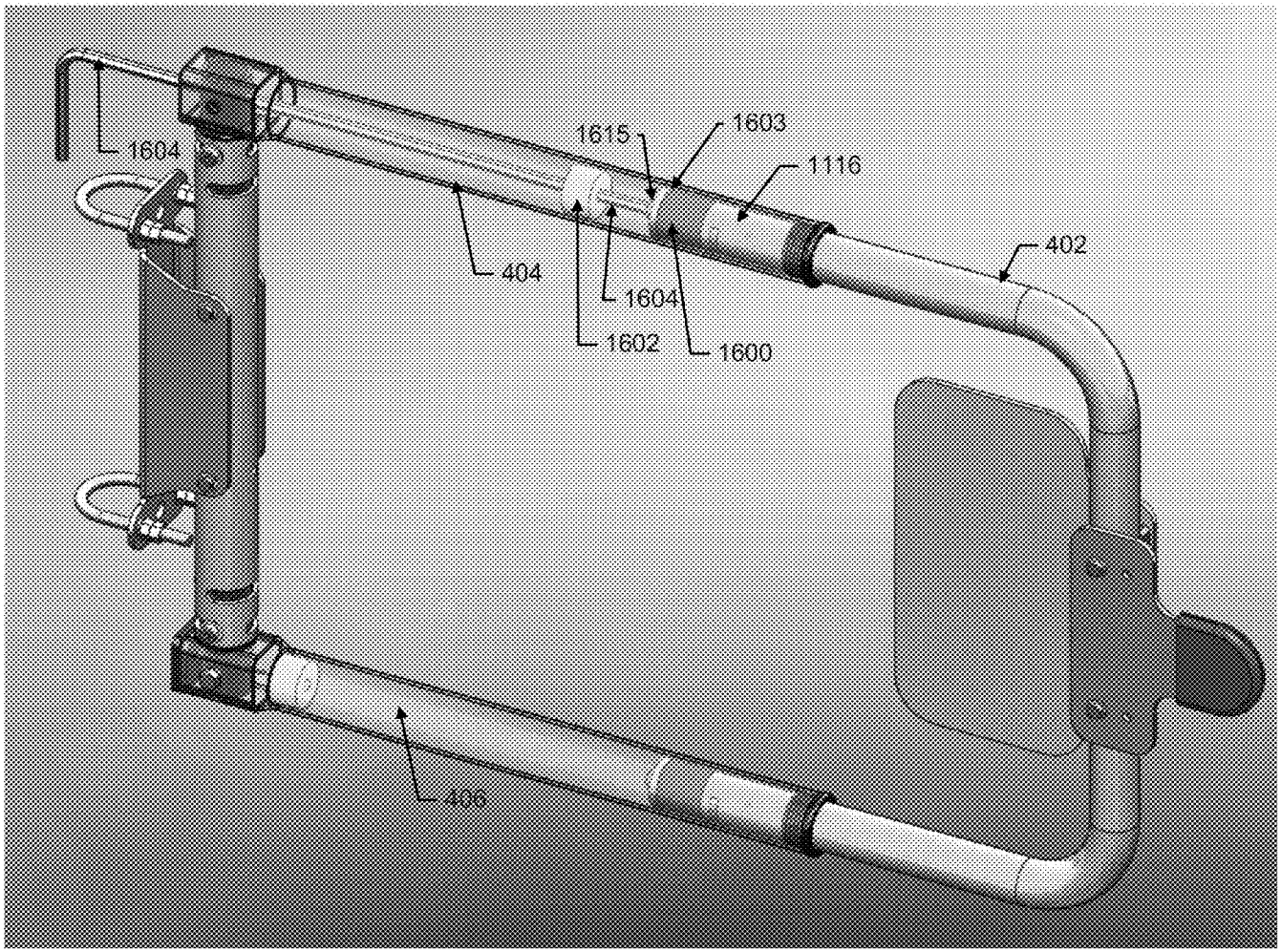
Figure 19A:
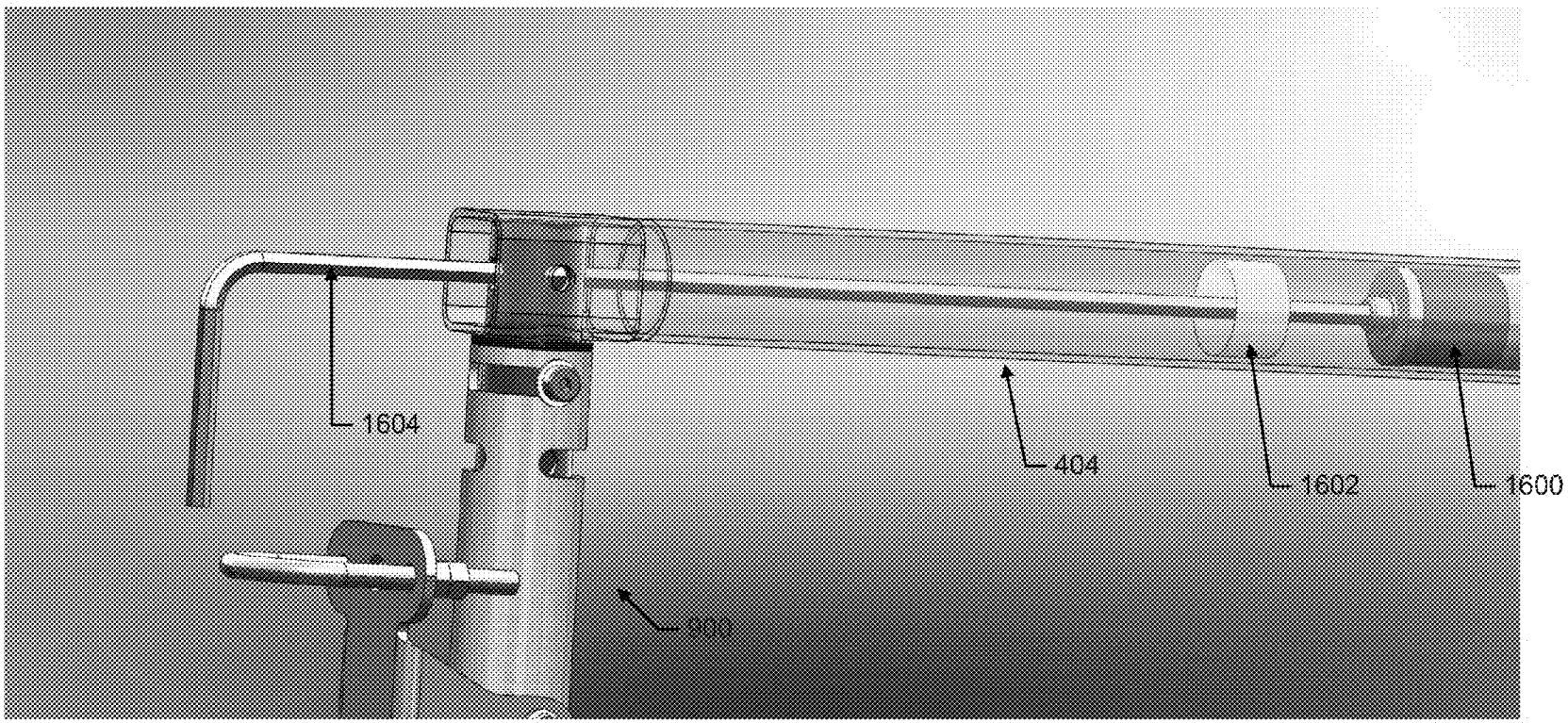
Figure 19B:
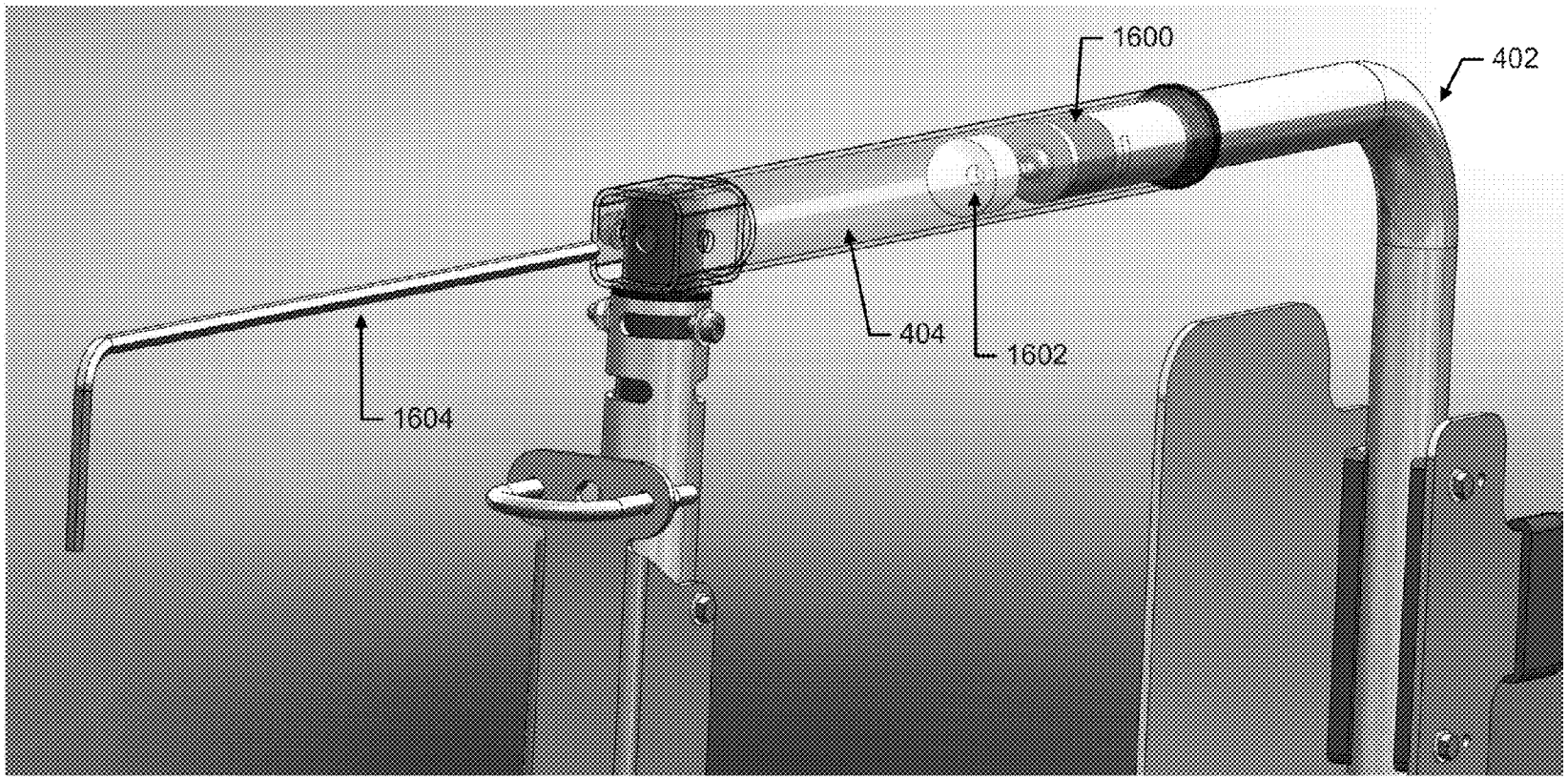

As illustrated in FIG. 18B and FIGS. 19A-B, the tool 1604 is inserted in the hollow cavity of supporting arm 404 and may be guided by a washer 1602. Washer 1602 has an aperture in the center which guides tool 1604 through the center of the hollow cavity of supporting arm 404 so that the end of tool 1604 can easily be mated with screw portion 1615. Once tool 1604 is mated with screw portion 1615, the tool is rotated to increase the compress compression fitting 1603 and, therefore, compression member 1600 until the outer surface of compression member is being increasingly compressed against the interior surface of the hollow interior surface of supporting arm 404. The tool continues to turn until while the compression member becomes more and more compressed with the interior surface of supporting arm 404. This creates more and more friction between compression member 1600 and supporting arm 404 such that the adjustable arm member cannot be removed from the supporting arm 404 due to the compression and/or friction caused thereby.

To release the compression member 1600 from supporting arm member 404 the tool is again inserted into screw portion 1615 and the tool is rotated in an opposite direction to reduce the diameter of compression fitting 1603. This also reduces the compression and thus the diameter of compression member 1600 until the outer surface of compression member 1600 is no longer compressed against the interior surface of the supporting arm 404. The tool may then be removed and the adjustable arm may then be moved to a different position or removed from supporting arm 404. It should be understood that the adjustable arm 402 may be moved to any continuous position within supporting arm. After moving the end 1116 or 1122 within the supporting arm 404, 406 respectively, the tool may be reinserted into the screw portion and turned again to lock the adjustable arm member 402 into place relative to the supporting arms 404, 406. It should be understood that the tool may be used to tighten a compression member 1600 in arm 404 and/or in arm 406.

It should be noted that the hinge may be mounted either on rail 108 or 110 and that the gate may swing either in one direction (e.g., toward rail 108) if mounted to rail 108 or may swing in the opposite direction (e.g., toward rail 110) if mounted to 110. In this regard, the gates described herein may be universal with regard to the swinging direction. Additionally, the gate is further universal in that the length is adjustable to fit any opening or accessway as previously discussed. The gate may be parallel mounted so that the gate, when closed, does not extend into the cage (or interior walkway) area at all. However, in the case where a user wants to use the complete opening (i.e., the space from the edge of the opening or accessway at rail 108 and the edge of the other side of the opening/accessway at rail 110), the gate may be perpendicularly mounted. This allows the hinge to not be disposed in the plane defined by the area between rail 108 and 110. As such, if there are items that need to be transported through the opening or accessway between rails 108 and 110 and such items are the width of the opening or accessway, the hinge of the gate does not take substantially any of the accessway or opening area since it is perpendicularly mounted thereto.

The accompanying drawings, which are incorporated in and constitute a part of this specification, illustrate one or more embodiments of the present invention. While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A gate comprising:

a spring-loaded hinge arrangement defining a rotational axis;

a gate structure having a first support arm connected to a first end of said hinge arrangement, said gate structure rotatable about said rotational axis; and said spring-loaded hinge arrangement including:

an outer hinge tube fixedly connectable to an adjacent structure; and an inner hinge tube received in said outer hinge tube, said inner hinge tube having a first portion and a second portion configured such that said first portion and said second portion of said inner hinge tube are portions of a unitary and continuous tube but are separated and joined by a cut location such that said first portion is connected to said second portion but rotates with respect to said second portion, said second portion of said inner hinge tube being fixed with respect to said outer hinge tube, said first portion of said inner hinge tube being fixed with respect to said support arm.

2. The gate of claim 1, wherein said gate structure further comprises a second support arm connected to a second end of said hinge arrangement.

3. The gate of claim 2, wherein a width of said gate structure is adjustable.

4. The gate of claim 1, wherein said inner hinge tube defines first and second cut locations separating respective first and second first portions from said second portion thereof.

5. The gate of claim 4, wherein said first and second first portions are located at opposite ends of said inner hinge tube along a length thereof.

6. The gate of claim 4, wherein said inner hinge tube has a substantially constant outer diameter along an entire length thereof.

7. The gate of claim 1, wherein said inner hinge tube has a substantially constant outer diameter along an entire length thereof.

8. The gate of claim 7, wherein said second portion of said inner hinge tube is rotatably adjustable with respect to said outer hinge tube.

9. The gate of claim 8, wherein said second portion of said inner hinge tube is fixed with respect to said outer hinge tube via at least one pin extending therethough.

10. The gate of claim 9, wherein said second portion of said inner hinge tube defines a plurality of apertures therethrough for receipt of said at least one pin.

* * * * *